US010518953B2

(12) United States Patent
Zhang

(10) Patent No.: US 10,518,953 B2
(45) Date of Patent: Dec. 31, 2019

(54) MULTILAYER AIR PACKAGING DEVICE AND STAGGERED LAMINATED AIR PACKAGING DEVICE

(71) Applicant: Shanghai Air-Paq Composite Material Co., Ltd., Shanghai (CN)

(72) Inventor: Diane Jiaying Zhang, Shanghai (CN)

(73) Assignee: Shanghai Air-Paq Composite Material Co., Ltd., Pudong, Shanghai (CN)

( * ) Notice: Subject to any disclaimer, the term of this patent is extended or adjusted under 35 U.S.C. 154(b) by 158 days.

(21) Appl. No.: 15/515,141

(22) PCT Filed: Sep. 24, 2015

(86) PCT No.: PCT/CN2015/090510
§ 371 (c)(1),
(2) Date: Mar. 28, 2017

(87) PCT Pub. No.: WO2016/050163
PCT Pub. Date: Apr. 7, 2016

(65) Prior Publication Data

US 2017/0217660 A1 Aug. 3, 2017

(30) Foreign Application Priority Data

| | | |
|---|---|---|
| Sep. 29, 2014 | (CN) | 2014 1 05140111 |
| Nov. 14, 2014 | (CN) | 2014 1 06482474 |
| Nov. 14, 2014 | (CN) | 2014 1 06482737 |
| Nov. 14, 2014 | (CN) | 2014 2 06833226 U |
| Nov. 14, 2014 | (CN) | 2014 2 06838075 U |

(51) Int. Cl.

| | |
|---|---|
| ***B65D 81/03*** | (2006.01) |
| ***B65D 65/40*** | (2006.01) |
| ***A45C 13/02*** | (2006.01) |
| ***B65D 81/05*** | (2006.01) |

(52) U.S. Cl.
CPC ..... *B65D 81/03* (2013.01); *A45C 13/021* (2013.01); *B65D 65/40* (2013.01); *B65D 81/052* (2013.01)

(58) Field of Classification Search
CPC ..... A45C 13/02; A45C 13/021; B65D 65/40; B65D 81/02; B65D 81/03; B65D 81/05; B65D 81/052
USPC ..... 206/522; 383/3
See application file for complete search history.

(56) References Cited

U.S. PATENT DOCUMENTS

| | | | | |
|---|---|---|---|---|
| 7,631,762 | B2 * | 12/2009 | Liao | B65D 81/052 206/522 |
| 8,714,356 | B2 * | 5/2014 | Liao | B65D 31/00 206/522 |
| 9,199,597 | B2 * | 12/2015 | Zhang | B65D 81/052 |

* cited by examiner

*Primary Examiner* — Bryon P Gehman
(74) *Attorney, Agent, or Firm* — Raymond Y. Chan; David and Raymond Patent Firm

(57) ABSTRACT

A multilayer staggered laminated air packaging device includes two or more layers of inflatable packaging bodies arranged in stack, a receiving chamber for storing articles to be packaged is formed by the inflatable packaging body which is located at the inner side, and the two or more layers of inflatable packaging bodies each includes one or more inflatable subunits, wherein at least one inflatable subunit of at least one layer of the inflatable packaging body is arranged in a stack staggered relative to at least one inflatable subunit corresponding to the other layer of the inflatable packaging body, so as to improve the damping performance of the staggered laminated air packaging device.

12 Claims, 19 Drawing Sheets

B-B

MULTILAYER AIR PACKAGING DEVICE AND STAGGERED LAMINATED AIR PACKAGING DEVICE

CROSS REFERENCE OF RELATED APPLICATION

This is a non-provisional application that claims the benefit of priority under 35 U.S.C. § 371 to international application number PCT/CN2015/090510, international filing date Sep. 24, 2015, wherein the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an air packaging device and producing method therefor, and more particularly to a multilayer air Packaging device and producing method therefor, and a staggered laminated air Packaging device and producing method therefor.

Description of Related Arts

In the modern logistics industries, packaging boxes are used widely. However, packaging methods of this kind of traditional packaging boxes have never provided shock absorption performance during collision or falling. In other words, during being transported and stored, the packaging boxes are usually thrown and are easy to deform their shapes, and may further lead to the damaging or breaking of the packaged items. Therefore, for some items that need to be protected in packaging, such as digital products, plastics, ceramics, biologics, chemicals, food and medicine, a cushioning effect should be provided to prevent the packaged items from being damaged during being transported and stored. According to traditional paper packaging boxes, existing solution is to fill cushioning foam materials into the paper packaging boxes to provide cushioning effect. However, the costs of transporting and storing are expensive during transporting using the packaging boxes and the cushioning foam materials filled. On the other hand, the cushioning foam materials are not environmentally friendly and may pollute the environment.

Another improved solution is a conventional inflatable bag in the market. The conventional inflatable bag includes four layers of film which formed by a series of heat sealing process. An inflatable air chamber is formed between two outer layers of films and the two inner layers of films form a one-way inflatable valve so as to fill the air chamber with air and so as to prevent the air within the air chamber from leaking out. The two outer layers of the film form a receiving chamber for receiving the packaged items after a series of folding steps. However, the cushioning performance of the single-layer inflatable bag formed by the two outer layers of film is still limited. For example, when one side wall of the inflatable bag is impacted, the air within the inflatable bag cannot be effectively dispersed, and the shape of the side wall of the inflatable bag cannot be restored in time, resulting in the impact of stress being concentrated in the local locations, so that the impact stress is delivered to the packaging items which results in the damage of the packaged items.

SUMMARY OF THE PRESENT INVENTION

The invention is advantageous in that it provides a multilayer air packaging device, wherein the multilayer air Packaging device comprises two or more layers of inflatable packaging bodies which are overlapped with each other, thereby enhancing the cushioning performance of the entire air Packaging device.

Another advantage of the invention is to provide a multilayer air packaging device, wherein the overlapped two or more layers of inflatable packaging bodies are heat sealed to form the entire multilayer air Packaging device. Alternatively, the two or more layers of inflatable packaging bodies are integrally formed, so that the producing method of the multilayer air Packaging device is easy.

Another advantage of the invention is to provide a multilayer air packaging device, wherein the multilayer air Packaging device comprises two layers of inflatable packaging bodies which are integrally formed by an interconnecting portion, so that the two layers of inflatable packaging bodies are overlapped with each other, thereby significantly enhancing the cushioning performance of the multilayer air packaging device.

Another advantage of the invention is to provide a multilayer air packaging device, wherein the two layers of inflatable packaging bodies comprises an inner-layer inflatable packaging body and an outer-layer inflatable packaging body. The inner-layer inflatable packaging body comprises a plurality of inner-layer inflatable units and the outer-layer inflatable packaging body comprises a plurality of outer-layer inflatable units, wherein the inner-layer inflatable units and the outer-layer inflatable units are overlapped with each other, so that the cushioning performance of the entire multilayer air Packaging device is enhanced by the overlapped inner-layer inflatable units and the outer-layer inflatable units.

Another advantage of the invention is to provide a multilayer air packaging device, wherein the inner-layer inflatable units of the inner-layer inflatable packaging body and the outer-layer inflatable units of the outer-layer inflatable packaging body have predetermined gaps instead of completely in contact with each other, so that the overlapped two layers of the inflatable units enhance the elastic restoring force of each side portions of the multilayer air Packaging device, thereby improving the cushioning performance of each side portions of the multilayer air Packaging device.

Another advantage of the invention is to provide a multilayer air packaging device, wherein when the outer-layer inflatable units is applied to the impact stress, air within the outer-layer inflatable units is temporarily distributed to the inner-layer inflatable units, while the cushioning recovery force of the inner-layer inflatable units causes the air back to the outer-layer inflatable units so as to return the outer-layer inflatable units to the initial state, thereby ensuring the air not being concentrated in a particular area.

Another advantage of the invention is to provide a multilayer air packaging device, wherein the inner-layer inflatable units and the outer-layer inflatable units relatively provide a multi-level air cushioning effect. The inner-layer inflatable units enhance the cushioning effect of the outer-layer inflatable units in turn, vice versa, the outer-layer inflatable units enhance the cushioning effect of the inner-layer inflatable units.

Another advantage of the invention is to provide a multilayer air packaging device, wherein the inner-layer inflatable units and the outer-layer inflatable units also can be incompletely overlapped with each other so as to reduce the thickness of the multilayer air Packaging device. The portions with weaker cushioning performance of the inflatable packaging body are reinforced by the portions with stronger cushioning performance of another inflatable packaging body which is overlapped with the weaker one thereof, thereby enhancing the cushioning performance of the multilayer air Packaging device.

Another advantage of the invention is to provide a multilayer air packaging device, wherein the overlapped inner-layer inflatable units and the outer-layer inflatable units respectively have same or different inflatable unit structures such as with different sizes and shapes, thereby providing a multi-level cushioning effect.

Another advantage of the invention is to provide a multilayer air packaging device, wherein the inner-layer inflatable units and the outer-layer inflatable units respectively are provided large-diameter air chambers and small-diameter air chambers. The different arrangements of the large-diameter air chambers and small-diameter air chambers enhance the cushioning performance and the adaptability to the packaged items.

Another advantage of the invention is to provide a multilayer air packaging device, wherein the multilayer air Packaging device has a simple structure and is easy to manufacture and is suitable for a large-scale application in the packaging field.

Another advantage of the invention is to provide a staggered laminated air packaging device, wherein the staggered laminated air packaging device comprises two or more layers of inflatable packaging bodies which are staggered overlapped with each other, thereby enhancing the cushioning performance of the entire staggered laminated air Packaging device.

Another advantage of the invention is to provide a staggered laminated air packaging device, wherein the overlapped two or more layers of inflatable packaging bodies are heat sealed to form the entire staggered laminated air Packaging device. Alternatively, the two or more layers of inflatable packaging bodies are integrally formed, so that the producing method of the staggered laminated air Packaging device is easy.

Another advantage of the invention is to provide a staggered laminated air packaging device, wherein the staggered laminated air Packaging device comprises two layers of inflatable packaging bodies which are integrally formed by an transition portion, so that the two layers of inflatable packaging bodies are staggered and laminated with each other, thereby significantly enhancing the cushioning performance of the staggered laminated air Packaging device.

Another advantage of the invention is to provide a staggered laminated air packaging device, wherein the two layers of inflatable packaging bodies comprises an inner-layer inflatable packaging body and an outer-layer inflatable packaging body. The inner-layer inflatable packaging body comprises a plurality of inner-layer inflatable units and the outer-layer inflatable packaging body comprises a plurality of outer-layer inflatable units, wherein the inner-layer inflatable units and the outer-layer inflatable units are overlapped with each other, so that the cushioning performance of the entire staggered laminated air Packaging device is enhanced by the overlapped inner-layer inflatable units and the outer-layer inflatable units.

Another advantage of the invention is to provide a staggered laminated air packaging device, wherein the inner-layer inflatable units of the inner-layer inflatable packaging body and the outer-layer inflatable units of the outer-layer inflatable packaging body are incompletely overlapped. In other words, a dividing seam between two adjacent inner-layer inflatable units of the inner-layer inflatable packaging body and a dividing seam between two adjacent outer-layer inflatable units of the outer-layer inflatable packaging body are staggered arranged, thereby improving the cushioning performance of each side portions of the staggered laminated air Packaging device.

Another advantage of the invention is to provide a staggered laminated air packaging device, wherein the position of the dividing seam of the inner-layer inflatable packaging body is uninflated and has a weak air cushioning performance, while the outer-layer inflatable packaging body corresponding to the position of the dividing seam of the inner-layer inflatable packaging body is the inflatable structure formed by the outer-layer inflatable units and the inflatable structure formed by the outer-layer inflatable units has a stronger inflatable structure. Similarly, the dividing seam of the outer-layer inflatable packaging body is uninflated and has a weak air cushioning performance, while the inner-layer inflatable packaging body corresponding to the position of the dividing seam of the outer-layer inflatable packaging body is the inflatable structure formed by the inner-layer inflatable units and the inflatable structure formed by the inner-layer inflatable units has a stronger inflatable structure. The staggered and laminated inner-layer inflatable packaging body and outer-layer inflatable packaging body ensure that the air cushioning performance of each of the sides of the entire staggered laminated air packaging device is enhanced and each of the sides have substantially uniform cushioning performance.

Another advantage of the invention is to provide a staggered laminated air packaging device, wherein the predetermined portions of each dividing seams of the staggered laminated air packaging device are twisted, so that each dividing seams which are on the inner-layer inflatable packaging body and on the outer-layer inflatable packaging body are staggered arranged instead of being linearly arranged, so that the inner-layer inflatable packaging body and the outer-layer inflatable packaging body are staggered arranged.

Another advantage of the invention is to provide a staggered laminated air packaging device, wherein the inner-layer inflatable packaging body and the outer-layer inflatable packaging body are staggered arranged, so that the vertex positions of the inner-layer inflatable units and the outer-layer inflatable units thereof are respectively staggered, thereby reducing the thickness of the laminated inner-layer inflatable units and the outer-layer inflatable units.

Another advantage of the invention is to provide a staggered laminated air packaging device, wherein the inner-layer inflatable units of the inner-layer inflatable packaging body and the outer-layer inflatable units of the outer-layer inflatable packaging body are staggered arranged with each other so as to form cushioning spaces between the inner-layer inflatable units and the outer-layer inflatable units. Therefore, the impact stress applied to the outer-layer inflatable units via the cushioning space is not directly transmitted to the packaged items. Instead, a predetermined cushioning effect is provided to the outer-layer inflatable units through the cushioning space. Then the inner-layer inflatable units further provide cushioning effects and effectively disperses the impact stress.

Another advantage of the invention is to provide a staggered laminated air packaging device, wherein when the outer-layer inflatable units are applied to the impact stress, air within the outer-layer inflatable units is temporarily distributed to the inner-layer inflatable units, while the cushioning recovery force of the inner-layer inflatable units causes the air back to the outer-layer inflatable units so as to return the outer-layer inflatable units to the initial state, thereby ensuring the air not being concentrated in a particular area.

Another advantage of the invention is to provide a staggered laminated air packaging device, wherein the inner-layer inflatable units and the outer-layer inflatable units are laminated so as to improve the elastic recovery performance, thereby providing a more efficient cushioning performance.

Another advantage of the invention is to provide a staggered laminated air packaging device, wherein the dividing seam between the inner-layer inflatable units corresponds to the main body of the outer-layer inflatable units. Thus, when heat conduction and heat radiation are transmitted to the dividing seam, the heat conduction and heat radiation are prevented by the air within the inner-layer inflatable units and the heat transfer is further prevented, so that the staggered laminated air packaging device of the present invention is also suitable for packaging the packaged items which need to be insulated.

Additional advantages and features of the invention will become apparent from the description which follows, and may be realized by means of the instrumentalities and combinations particular point out in the appended claims.

According to the present invention, the foregoing and other objects and advantages are attained by a multilayer air packaging device, comprising: two or more layers of inflatable packaging bodies which are overlapped with each other, wherein a receiving chamber for receiving a packaged item is formed by the inflatable packaging body which is located at an inner side, wherein the inflatable packaging body which is located at an outer side and the inflatable packaging body which is located at the inner side are inflatable so as to enhance a cushioning performance of the multilayer air packaging device.

According to one embodiment of the present invention, the two or more layers of inflatable packaging bodies comprise 2-20 layers of inflatable packaging bodies.

According to an embodiment of the present invention, the two or more layers of inflatable packaging bodies comprise an inner-layer inflatable packaging body and an outer-layer inflatable packaging body, wherein the inner-layer inflatable packaging body forms the receiving chamber and is provided in the outer-layer inflatable packaging body.

According to an embodiment of the present invention, a connection method of the two or more layers of inflatable packaging bodies is selected from the group consisting of heat sealing and adhering.

According to an embodiment of the present invention, the inner-layer inflatable packaging body and the outer-layer inflatable packaging body are overlapped or staggered with each other and form a triangle cushioning structure in a corner.

According to an embodiment of the present invention, the inner-layer inflatable packaging body and the outer-layer inflatable packaging body are integrally connected and are formed by an inflatable main body.

According to an embodiment of the present invention, the inflatable main body comprises a plurality of inflatable cells and one or more dividing seams dividing each two adjacent inflatable cells, wherein each inflatable cell forms a plurality of communicated sub-inflatable cells by a plurality of bending seams and the plurality of communicated sub-inflatable cells respectively form the inner-layer inflatable packaging body and the outer-layer inflatable packaging body.

According to an embodiment of the present invention, the multilayer air packaging device further comprises one or more interconnecting portions, wherein the inner-layer inflatable packaging body and the outer-layer inflatable packaging body are integrally connected by the interconnecting portions and each interconnecting portion is formed between the bending seams.

According to an embodiment of the present invention, the inner-layer inflatable packaging body comprises one or more folding portions so that one or more corner positions of the inner-layer inflatable packaging body are respectively right angle configurations after being folded.

According to an embodiment of the present invention, the amount of the inflated air of the folding portions is reduced by a plurality of air blocking seams.

According to an embodiment of the present invention, the folding portions are uninflated portions which cannot be inflated.

According to an embodiment of the present invention, the inner-layer inflatable packaging body and the outer-layer inflatable packaging body respectively comprise sub-inflatable cells with different diameters or sub-inflatable cells with same diameters.

According to an embodiment of the present invention, a side portion of the inner-layer inflatable packaging body comprises one or more sub-inflatable cells with large diameters.

According to an embodiment of the present invention, the inner-layer inflatable packaging body further comprises an inner connecting seam provided between a first air chamber layer and a second chamber layer of a side portion of the inner-layer inflatable packaging body.

According to an embodiment of the present invention, the sub-inflatable cells of the inner-layer inflatable packaging body/the outer-layer inflatable packaging body further comprise a plurality of branch inflatable units by a branch dividing seam, wherein a diameter of the branch inflatable units are smaller than a diameter of the sub-inflatable cells of the outer-layer inflatable packaging body/the inner-layer inflatable packaging body.

According to an embodiment of the present invention, the dividing seams have a vertical or inclined or curved transition on the connection of the inner-layer inflatable packaging body and the outer-layer inflatable packaging body, so that the overlapped sub-inflatable cells have a staggered structure.

According to an embodiment of the present invention, the inflatable main body is formed by the first air chamber layer and the second air chamber layer after being heat sealed or being folded, wherein the inflatable main body forms an air inflating opening and a main channel and each of the inflatable main bodies are provided with an inflating valve, so that air enters the main channel and enters into each of the inflatable cells from the main channel via the inflating valve.

According to an embodiment of the present invention, the inflating valve comprises two valve films being respectively heat sealed together with the first chamber layer and the second chamber layer of the inflatable cell of the inflatable main body, wherein an air inflating channel in formed between two valve films, wherein after air is inflated into the inflatable cells through the air inflating channel, the inner surfaces of two valve films are attached together automatically so as to avoid the air entered into the inflatable cell from being leaked through the air inflating channel.

According to an embodiment of the present invention, the inflating valve is a self-adhesive film valve, wherein the inflating valve comprises a first valve film, a second valve film and a non-return sealing film, wherein the first valve film and the second valve film are outer layers and the non-return sealing film is provided between the first and the second valve film, wherein an air inflating channel is provided between the first valve film and the non-return sealing film and a non-return cavity is formed between the second valve film and the non-return sealing film, wherein after air is inflated into the inflatable cells through the air inflating channel, the inner surfaces of the first valve film, the second value film are attached together automatically so as to avoid the air entered into the inflatable cell from being leaked through the air inflating channel, so that when the returned air selectively enters the non-return cavity, the air within the non-return cavity has a press effect on the second valve film so as to further enclose the air inflating channel, thereby preventing air reverse osmosis.

According to the present invention, the foregoing and other objects and advantages are attained by a multilayer air packaging device, comprising:

an inner-layer inflatable packaging body; and at least one outer-layer inflatable packaging body, wherein the inner-layer inflatable packaging body comprises a plurality of inner-layer inflatable units and forms a receiving chamber for receiving a packaged item, wherein the outer-layer inflatable packaging body comprises a plurality of outer-layer inflatable units, wherein the inner-layer inflatable units of the inner-layer inflatable packaging body and the outer-layer inflatable units of the outer-layer inflatable packaging body are overlapped with each other so as to form a multilayer air cushioning structure.

According to an embodiment of the present invention, the inner-layer inflatable units of the inner-layer inflatable packaging body form an inner bottom side wall, an inner front side wall and an inner back side wall connected with each other, wherein the outer-layer inflatable units of the outer-layer inflatable packaging body form an outer front side wall, an outer back side wall and an outer bottom side wall connected with each other, wherein the inner front side wall and the inner back side wall respectively form a multilayer structure with the outer bottom side wall, the outer front side wall and the outer back side wall.

According to an embodiment of the present invention, the outer-layer inflatable packaging body further comprises an outer bottom wall formed by the outer-layer inflatable units, wherein the outer-layer inflatable units of the outer bottom wall and the inner-layer inflatable units of the inner bottom wall are overlapped with each other.

According to an embodiment of the present invention, the inner-layer inflatable packaging body further comprises an inner left side wall and an inner right side wall formed by the inner-layer inflatable units and the outer-layer inflatable packaging body further comprises an outer left side wall and an outer right side wall formed by the outer-layer inflatable units.

According to an embodiment of the present invention, the inner-layer inflatable packaging body or the outer-layer inflatable packaging body further respectively comprises a top side wall formed by the inner-layer inflatable units or the outer-layer inflatable units.

According to an embodiment of the present invention, a connection method of the inner-layer inflatable packaging body and the outer-layer inflatable packaging body is selected from the group consisting of heat sealing and adhering.

According to an embodiment of the present invention, the inner-layer inflatable packaging body and the outer-layer inflatable packaging body are integrally connected and are formed by an inflatable main body, wherein the inflatable main body comprises a plurality of inflatable cells aligned side by side and one or more dividing seams dividing each two adjacent inflatable cells, wherein each of the inflatable cells are divided into a plurality of communicated sub-inflatable cells by a plurality of bending seams and the plurality of communicated sub-inflatable cells form the inner-layer inflatable units and the outer-layer inflatable units which are arranged along a longitudinal direction.

According to an embodiment of the present invention, the inner-layer inflatable units and the outer-layer inflatable units have air chamber units with different diameters or with same diameters.

According to an embodiment of the present invention, the sub-inflatable cells of the inner-layer inflatable units or the outer-layer inflatable units thereof are further divided into a plurality of branch inflatable units by a branch dividing seam, so that the multilayer air packaging device forms a multilayer cushion structure having layers with different cushioning performances.

According to an embodiment of the present invention, the inflatable main body is formed by the first air chamber layer and the second air chamber layer after being heat sealed and being folded, wherein the inflatable main body forms an air inflating opening and a main channel and each of the inflatable main bodies are provided with an inflating valve, so that air enters the main channel and enters into each of the inflatable cells from the main channel via the inflating valve.

According to the present invention, the foregoing and other objects and advantages are attained by a producing method for a multilayer air packaging device, comprising the following steps of:

(a) overlapping a first air chamber layer, a second air chamber layer and valve films forming an inflating valve with each other, and forming an inflatable main body for receiving air after being heat sealed;

(b) heat sealing the inflatable main body along a plurality of dividing seams so as to form a plurality of individual inflatable units and each inflatable unit provided with at least one of the inflating valve, wherein the inflatable main body forms an air inflating opening and a main channel and air enters the main channel and enters into each of the inflatable cells from the main channel via the inflating valve; and (c) heat sealing each inflatable units along a plurality of bending seams so as to form a plurality of communicated sub-inflatable cells and to form a plurality of side walls and bending the plurality of side walls along the bending seams so as to form the multilayer air packaging device having an inner-layer inflatable packaging body and an outer-layer inflatable packaging body, wherein the inner-layer inflatable packaging body forms a receiving chamber for receiving a packaged item and the outer-layer inflatable packaging body is overlapped on an outer side of the inner-layer inflatable packaging body so as to form a multilayer air cushioning structure.

According to an embodiment of the present invention, the diameters of the sub-inflatable cells have consistency or the sub-inflatable cells form a structure with large-diameter air chambers and small-diameter air chambers.

According to an embodiment of the present invention, further comprising a step of: forming large-diameter air chambers on a side portion of the inner-layer inflatable packaging body, wherein the inner surfaces of the large-diameter air chambers are curve-shaped so as to easy to fit and retain the packaged item.

According to an embodiment of the present invention, further comprising a step of: heat sealing the side portion of the inner-layer inflatable packaging body along an inner connecting seam, so that the side portion of the inner-layer inflatable packaging body forms a laminated structure formed by a plurality of the sub-inflatable cells, thereby enhancing the cushioning performance of the side portion of the multilayer air packaging device.

According to an embodiment of the present invention, further comprising a step of: forming a vertical or inclined or curved transition on the connection of the inner-layer inflatable packaging body and the outer-layer inflatable packaging body by the dividing seams.

According to an embodiment of the present invention, further comprising a step of: heat sealing the sub-inflatable cells of the inner-layer inflatable packaging body or the outer-layer inflatable packaging body along the position of branch dividing seams so as to further divide into branch inflatable units with small-diameters.

According to the present invention, the foregoing and other objects and advantages are attained by a staggered laminated air packaging device, comprising:

two or more layers of inflatable packaging bodies which are laminated with each other, wherein a receiving chamber for receiving a packaged item is formed by the inflatable packaging body which is located at an inner side, wherein the two or more layers of inflatable packaging bodies respectively comprises one or more sub-inflatable cells, wherein in the two or more layers of inflatable packaging bodies, at least one sub-inflatable cell of at least one layer of the inflatable packaging bodies is staggered laminated with at least one corresponding sub-inflatable cell of other layer of inflatable packaging bodies, thereby enhancing a cushioning performance of the staggered laminated air packaging device.

According to an embodiment of the present invention, the two or more layers of inflatable packaging bodies comprise 2-20 layers of inflatable packaging bodies.

According to an embodiment of the present invention, the two or more layers of inflatable packaging bodies comprise an inner-layer inflatable packaging body and an outer-layer inflatable packaging body, wherein the inner-layer inflatable packaging body forms the receiving chamber and is provided in the outer-layer inflatable packaging body.

According to an embodiment of the present invention, a connection method of the two or more layers of inflatable packaging bodies is selected from the group consisting of heat sealing and adhering.

According to an embodiment of the present invention, the inner-layer inflatable packaging body and the outer-layer inflatable packaging body are integrally connected and are formed by an inflatable main body, wherein the inner-layer inflatable packaging body and the outer-layer inflatable packaging body respectively comprises inner-layer inflatable units and outer-layer inflatable units formed by the sub-inflatable cells, wherein the inner-layer inflatable units and outer-layer inflatable units are staggered laminated.

According to an embodiment of the present invention, the staggered laminated air packaging device further comprises one or more transition portions, wherein the inner-layer inflatable packaging body and the outer-layer inflatable packaging body are integrally connected by the transition portions.

According to an embodiment of the present invention, the inflatable main body comprises a plurality of inflatable cells aligned side by side and one or more dividing seams dividing each two adjacent inflatable cells, wherein each inflatable cell forms a plurality of the communicated sub-inflatable cells by a plurality of bending seams, wherein the transition portions comprises one or more transition inflatable units and transition seams provided on the transition inflatable units, wherein one dividing seam of the inner-layer/outer-layer inflatable packaging body is staggered with other one dividing seam of the outer-layer/inner-layer inflatable packaging body.

According to an embodiment of the present invention, the transition seams are respectively inclinedly or curvedly extended from the dividing seams.

According to an embodiment of the present invention, the transition seams are extended from the dividing seams in a form of L-shape.

According to an embodiment of the present invention, the inflatable main body comprises a plurality of inflatable cells aligned side by side and one or more dividing seams dividing each two adjacent inflatable cells, wherein each inflatable cell form a plurality of the communicated sub-inflatable cells by a plurality of bending seams, wherein the connecting position of the inner-layer inflatable packaging body and the outer-layer inflatable packaging body forms transition seams, wherein the transition seams are longitudinally extended form the dividing seams so that one dividing seam of the inner-layer/outer-layer inflatable packaging body is staggered with other one dividing seam of the outer-layer/inner-layer inflatable packaging body.

According to an embodiment of the present invention, two adjacent transition seams are extended toward the same direction or toward opposite directions.

According to an embodiment of the present invention, the inner-layer inflatable packaging body comprises one or more folding portions so that corner positions of the inner-layer inflatable packaging body are right angle configurations after being folded, wherein the outer-layer inflatable packaging body comprises one or more folding portions so that the corner positions of the outer-layer inflatable packaging body are right angle configurations after being folded.

According to an embodiment of the present invention, the amount of the inflated air of the folding portions is reduced by a plurality of air blocking seams.

According to an embodiment of the present invention, the folding portions are uninflated portions which cannot be inflated.

According to an embodiment of the present invention, the inner-layer inflatable packaging body and the outer-layer inflatable packaging body respectively comprise sub-inflatable cells with different diameters or sub-inflatable cells with same diameters.

According to an embodiment of the present invention, a side portion of the inner-layer inflatable packaging body comprises one or more sub-inflatable cells with large diameters.

According to an embodiment of the present invention, the inner-layer inflatable packaging body further has an inner connecting seam provided between each two adjacent inner-layer inflatable units of a side portion of the staggered laminated air packaging device.

According to an embodiment of the present invention, an inflatable chamber is provided adjacent to the inner connecting seam, so that more cushioning spaces between air chambers of the inner-layer inflatable units of a side portion of the staggered laminated air packaging device are enlarged.

According to an embodiment of the present invention, the inflatable main body is formed by the first air chamber layer and the second air chamber layer after being heat sealed and being folded, wherein the inflatable main body forms an air inflating opening and a main channel and each of the inflatable main bodies are provided with an inflating valve, so that air enters the main channel and enters into each of the inflatable cells from the main channel via the inflating valve.

According to an embodiment of the present invention, the inflating valve comprises two valve films being respectively heat sealed together with the first chamber layer and the second chamber layer of the inflatable cell of the inflatable main body, wherein an air inflating channel in formed between two valve films, wherein after air is inflated into the inflatable cells through the air inflating channel, the inner surfaces of two valve films are attached together automatically so as to avoid the air entered into the inflatable cell from being leaked through the air inflating channel.

According to an embodiment of the present invention, the inflating valve is a self-adhesive film valve, wherein the inflating valve comprises a first valve film, a second valve film and a non-return sealing film, wherein the first valve film and the second valve film are outer layers and the non-return sealing film is provided between the first and the second valve film, wherein an air inflating channel is provided between the first valve film and the non-return sealing film and a non-return cavity is formed between the second valve film and the non-return sealing film, wherein after air is inflated into the inflatable cells through the air inflating channel, the inner surfaces of the first valve film, the second value film are attached together automatically so as to avoid the air entered into the inflatable cell from being leaked through the air inflating channel, so that when the returned air selectively enters the non-return cavity, the air within the non-return cavity has a press effect on the second valve film so as to further enclose the air inflating channel, thereby preventing air reverse to outside.

According to the present invention, the foregoing and other objects and advantages are attained by a staggered laminated air packaging device, comprising:

an inner-layer inflatable packaging body and an outer-layer inflatable packaging body connected with the inner-layer inflatable packaging body, wherein the inner-layer inflatable packaging body comprises a plurality of inner-layer inflatable units, wherein the inner-layer inflatable units form an inner bottom wall, an inner front side wall and an inner back side wall connected with each other and defines a receiving chamber for receiving a packaged item, wherein the outer-layer inflatable packaging body comprises a plurality of outer-layer inflatable units, wherein the outer-layer inflatable units from an outer front side wall and an outer back side wall, wherein the inner front side wall and the inner back side wall of the inner-layer inflatable units are respectively staggered laminated with the outer front side wall and the outer back side wall of the outer-layer inflatable units.

According to an embodiment of the present invention, the outer-layer inflatable packaging body further comprises an outer bottom wall formed by the outer-layer inflatable units, wherein the outer-layer inflatable units of the outer bottom wall and the inner-layer inflatable units of the inner bottom wall are staggered laminated with each other.

According to an embodiment of the present invention, the inner-layer inflatable packaging body further comprises an inner left side wall and an inner right side wall formed by the inner-layer inflatable units and the outer-layer inflatable packaging body further comprises an outer left side wall and an outer right side wall formed by the outer-layer inflatable units.

According to an embodiment of the present invention, the inner-layer inflatable packaging body or the outer-layer inflatable packaging body further respectively comprises a top side wall formed by the inner-layer inflatable units or the outer-layer inflatable units.

According to an embodiment of the present invention, a connection method of the inner-layer inflatable packaging body and the outer-layer inflatable packaging body is selected from the group consisting of heat sealing and adhering.

According to an embodiment of the present invention, the inner-layer inflatable packaging body and the outer-layer inflatable packaging body are integrally connected and are formed by an inflatable main body, wherein the inflatable main body comprises a plurality of inflatable cells aligned side by side and one or more dividing seams dividing each two adjacent inflatable cells, wherein each inflatable cell is divided into a plurality of communicated sub-inflatable cells by a plurality of bending seams and the plurality of communicated sub-inflatable cells form the inner-layer inflatable units and the outer-layer inflatable units which are arranged along a longitudinal direction, wherein a part of the dividing seam along the longitudinal direction forms the bending seam, so that one dividing seam of the inner-layer/outer-layer inflatable packaging body is staggered with other one dividing seam of the outer-layer/inner-layer inflatable packaging body.

According to the present invention, the foregoing and other objects and advantages are attained by a producing method for a staggered laminated air packaging device, comprising the following steps of:

(a) laminating a first air chamber layer, a second air chamber layer and valve films forming an inflating valve with each other, and forming an inflatable main body for receiving air after being heat sealed;

(b) heat sealing the inflatable main body along a plurality of dividing seams so as to form a plurality of individual inflatable units and each inflatable unit provided with at least one of the inflating valve, wherein the inflatable main body forms an air inflating opening and a main channel and air enters the main channel and enters into each of the inflatable cells from the main channel via the inflating valve; and (c) heat sealing each inflatable units along a plurality of bending seams so as to form a plurality of communicated sub-inflatable cells and to form a plurality of side walls and bending the plurality of side walls along the bending seams so as to form an air packaging body with spatial configuration, wherein a part of the dividing seam forms one or more transition seams, wherein two adjacent sub-inflatable units along a longitudinal direction are staggered laminated with each other after being bended along the transition seams, so that the air packaging body with spatial configuration forms the staggered laminated air packaging device.

According to an embodiment of the present invention, further comprising a step of: bending the plurality of side walls so as to form two or more layers of inflatable packaging bodies.

According to an embodiment of the present invention, the two or more layers of inflatable packaging bodies comprises an inner-layer inflatable packaging body and an outer-layer inflatable packaging body, wherein the inner-layer inflatable packaging body forms a receiving chamber for receiving a packaged item, wherein the outer-layer inflatable packaging body provided on an outer side of the inner-layer inflatable packaging body and forms a staggered laminated structure with the inner-layer inflatable packaging body.

According to an embodiment of the present invention, the diameters of the sub-inflatable cells have consistency or the sub-inflatable cells form a structure with large-diameter air chambers and small-diameter air chambers.

According to an embodiment of the present invention, further comprising a step of: forming large-diameter air chambers on a side portion of the inner-layer inflatable packaging body, wherein the inner surfaces of the large-diameter air chambers are curve-shaped so as to easy to fit and retain the packaged item.

According to an embodiment of the present invention, further comprising a step of: heat sealing the side portion of the inner-layer inflatable packaging body along an inner connecting seam, so that the side portion of the inner-layer inflatable packaging body forms a laminated structure formed by a plurality of the sub-inflatable cells, thereby enhancing the cushioning performance of the side portion of the staggered laminated air packaging device.

According to an embodiment of the present invention, further comprising a step of: the transition seams are vertically or inclinedly or curvedly extended from a partial position of the dividing seams.

According to an embodiment of the present invention, further comprising a step of: forming one or more transition portion connecting the inner-layer inflatable packaging body and the outer-layer inflatable packaging body, wherein the transition portions comprises one or more transition inflatable units provided between the transition seams.

Still further objects and advantages will become apparent from a consideration of the ensuing description and drawings.

These and other objectives, features, and advantages of the present invention will become apparent from the following detailed description, the accompanying drawings, and the appended claims.

BRIEF DESCRIPTION OF THE DRAWINGS

FIG. 33 is a schematic view of the staggered laminated air packaging device according to the second preferred embodiment of the present invention, illustrating the top structure of the staggered laminated air packaging device.

DETAILED DESCRIPTION OF THE PREFERRED EMBODIMENT

Figure 1:
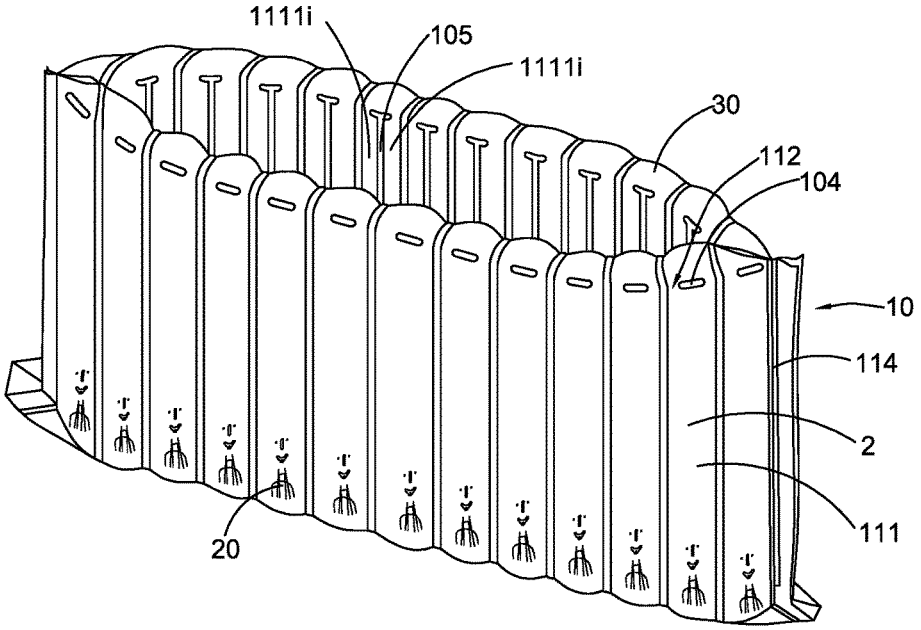
FIG. 1 is a perspective view of a multilayer air packaging device according to a first preferred embodiment of the present invention.
Figure 2:
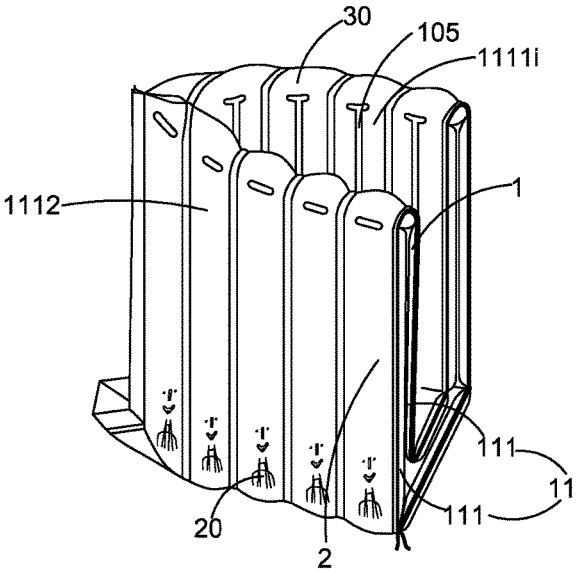
FIG. 2 is a sectional view of the multilayer air packaging device according to the above first preferred embodiment of the present invention.
Figure 3:
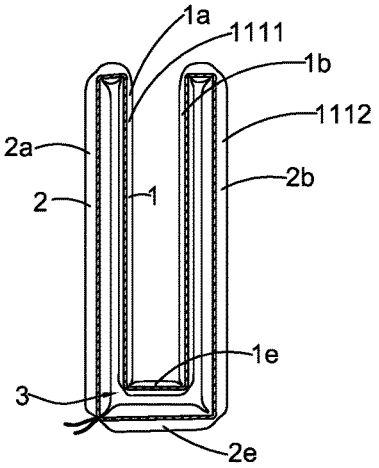
FIG. 3 is a sectional view of FIG. 2.
Figure 4:
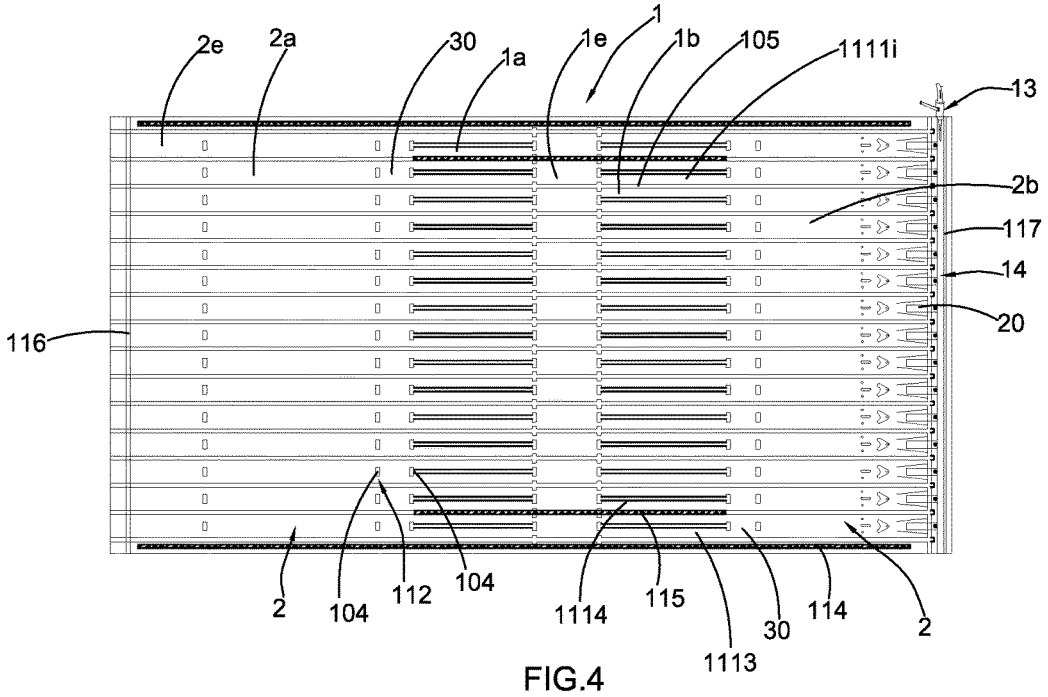
FIG. 4 is a schematic view of the multilayer air packaging device according to the first preferred embodiment of the present invention, wherein the multilayer air pack device is not inflated and is unfolded.
Figure 5:
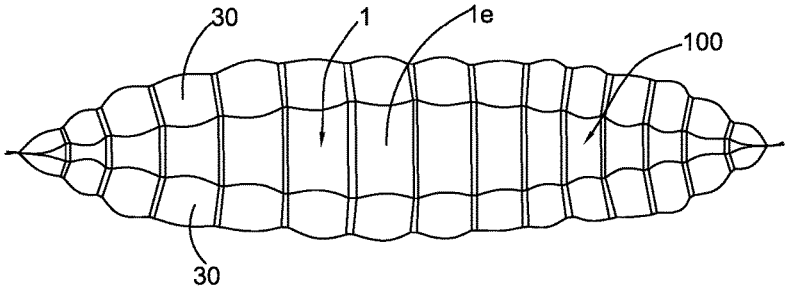
FIG. 5 is a schematic view of the multilayer air pack device according to the first preferred embodiment of the present invention, illustrating the top structure of the multilayer air pack device.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 1 to FIG. 6 of the drawings, a multilayer air packaging device according to a first preferred embodiment of the present invention is illustrated. The multilayer air packaging device can be used to store packaged items, such as electronic products, food, medicine products, chemical materials, biological materials, plastics, ceramics, and Fast Moving Consumer Goods. As the multilayer air packaging device has cushion performance, so that the multilayer air packaging device is suitable to be used to provide an air cushion performance for the packaged items. One skilled in the art will understand that the packaged items are not limited to the examples described above. The multilayer air packaging device of the present invention can also be applied into the package of other types of items according to actual needs.

Specifically, the multilayer air packaging device comprises two or more layers of inflatable packaging bodies which are overlapped with each other, thereby enhancing the cushioning performance of the entire air packaging device. One skilled in the art shall understand that the two or more inflatable packaging bodies can be implemented as a two-layer of inflatable packaging body, a three-layer of inflatable packaging body or more layers of inflatable packaging body. In this preferred embodiment, the two-layer of inflatable packaging body is illustrated as an example, wherein the two-layer of inflatable packaging body comprises an inner-layer inflatable packaging body 1 and an outer-layer inflatable packaging body 2, wherein the inner-layer inflatable packaging body 1 and the outer-layer inflatable packaging body 2 are overlapped and may even be staggered with each other so as to enhance the cushioning performance of the peripheral wall of the multilayer air packaging device.

The inner-layer inflatable packaging body 1 and the outer-layer inflatable packaging body 2 can be implemented as a separate inflatable structure respectively and are connected to each other by a connecting manner such as a heat-seal connection so as to form an entire connected structure. Also the inner-layer inflatable packaging body 1 and the outer-layer inflatable packaging body 2 can be implemented as an integrated structure. In the preferred embodiment of the present invention, take the integrated structure as an example, the inner-layer inflatable packaging body 1 and the outer-layer inflatable packaging body 2 are integrally formed by an inflatable main body 10. Of course, the whole structure which is formed by the separate inner-layer inflatable packaging body 1 and the separate outer-layer inflatable packaging body 2 also has multi-layer structure, thereby enhancing the cushioning performance of the multilayer air packaging device.

In this preferred embodiment of the present invention, the inner-layer inflatable packaging body 1 and the outer-layer inflatable packaging body 2 are in a laminated arrangement. More specifically, the inflatable main body 10 comprises an inflatable cell 11, wherein the inflatable cell 11 comprises a first chamber layer 101 and a second chamber layer 102. The first chamber layer 101 and the second chamber layer 102 overlap with each other to form an inflatable cavity 12 and to form at least one air inflating opening 13. The air inflating opening 13 communicates with the inflatable cavity 12, so as to be used to inflate air into the inflatable cavity 12. As shown in the drawings, two or more inflatable cells 11 are arranged side by side so as to form the inflatable main body 10, wherein an inflating valve 20 is provided to each inflatable cell 11. In other words, each inflatable cell 11 can be inflated independently. An extending dividing seam 103 is formed between two adjacent inflatable cells 11, wherein the dividing seam 103 can be implemented as a heat sealing line between each two adjacent inflatable cells 11, so that the inflatable cavity 12 is divided into a plurality of individual inflatable cavity 12 via the dividing seam 103. Thus, when one of the inflatable cells 11 is damaged to leak air, other inflatable cells 11 will not be affected. Of course, it is worth mentioning that the inflatable cells 11 can also communicate with each other. Thus only one inflating valve 20 is needed to inflate to all of the inflatable cells 11. In other words, the multilayer air Packaging device according to the present invention can form a plurality of inflatable cells 11 via the heat sealing of the first chamber layer first chamber layer 101 and the second chamber layer 102.

In addition, due to the shape of each of the inflatable cells 11 can be changed after being inflated, the inflatable main body 10 can be made to form various of shapes and sizes. The inflatable cells 11 can be strip (such as horizontal strip and/or lengthways strip), lump and so on. The shape thereof is not limited. According to the preferred embodiment of the present invention, the shape of the inflatable cells 11 can be strip shape. According to the preferred embodiment of the present invention, the inflatable main body 10 can also form an inflating channel 14. The inflating channel 14 communicates with the air inflating opening 13 and communicates with each of the inflatable cells 11 via one or more of the inflating valve 20. Thus, while inflating air through the air inflating opening 13, air will enter into the inflating channel 14, then the inflating channel 14 guides air into each of the inflating valve 20, and then air enters into each of the inflatable cells 11. In other words, the inflating channel 14 is an air distributing channel, which distributes the air being inflated from the air inflating opening 13 to each of the inflatable cells 11. An inflating mouth can be provided to the air inflating opening 13, so as to connect an inflating device, such as an air pump so as to fill air into the multilayer air Packaging device.

Each of the inflatable cells 11 of the inflatable main body 10 respectively has a plurality of bending seams 104. Thus, each of the inflatable cells 11 further forms a plurality of corresponding sub-inflatable cells 111. It is worth mentioning that the position of the bending seams 104 of the inflatable cells 11 are corresponding. In other words, the inflatable main body 10 has more than one line of the bending seams 104. The bending seams 104 being provided to the inflatable cells 11 are linear arranged but not continuously. The inflatable main body 10 can be folded along the bending seams 104, wherein a side wall is formed between two adjacent lines of the bending seams 104, so that the multilayer air packaging device with air cushioning performance forms a plurality of side walls. The plurality of side walls surrounds to form a receiving cavity so as to receive the packaged items. It is worth mentioning that the inflatable main body 10 has a plurality of the bending seams 104 for bending, wherein the bending seams 104 are alternately aligned with each other, so that the inflatable main body 10 forms a plurality of air chamber side walls along the bending seams 104, thereby forming the inner-layer inflatable packaging body 1 and the outer-layer inflatable packaging body 2.

In this preferred embodiment of the present invention, the inflatable main body 10 forms an 30 integrally connected with the inner-layer inflatable packaging body 1 and the outer-layer inflatable packaging body 2. The interconnecting portion 30 comprises a plurality of transition seams 31 and a plurality of transition units 32 extended between each two adjacent transition seams 31 respectively. The transition seams 31 are inclinedly extended between the inner-layer inflatable packaging body 1 and the inflatable cells 11 of the outer-layer inflatable packaging body 2 and are connected to the dividing seam 103.

In addition, the number of the bending seams 104 of each of the inflatable cells 11 can be provided as requirement. In other words, the number of the line of the bending seams 104 of the inflatable main body 10 can change, so that the corresponding inflatable main body 10 can have a plurality of side walls. So that the multilayer air packaging device forms different shapes of receiving spaces so as to form the multilayer air Packaging device with different shapes and configurations.

In addition, these bending seams 104 have not completely separated adjacent sub-inflatable cells 111. In other words, at least one communicating channel 112 is formed between each two adjacent sub-inflatable cells 111, so that while inflating, air enters into each of the sub-inflatable cells 111 through these communicating channels 112. According to the embodiment shown in the drawing, each of the bending seams 104 is formed to the center position between each two adjacent sub-inflatable cells 111 by heat sealing. The communicating channel 112 is formed on the two sides of the bending seams 104. According to other embodiment, two end portions of each sub-inflatable cell 111 form the bending seams 104 and the middle portion of each sub-inflatable cells 111 forms the communicating channel 112.

As shown in the drawings, the sub-inflatable cells 111 of the inner-layer inflatable packaging body 1 and the sub-inflatable cells 111 of the outer-layer inflatable packaging body 2 are overlapped with each other so as to form a two-layer structure. Furthermore, the sub-inflatable cells 111 of the inflatable cells 11 are aligned along the longitudinal direction so as to respectively form a plurality of inner-layer inflatable units 1111 of the inner-layer inflatable packaging body 1 and a plurality of outer-layer inflatable units 1112 of the outer-layer inflatable packaging body 2. The inner-layer inflatable units 1111 and the outer-layer inflatable units 1112 are extended as extending sections from each other and are integrally connected to form the inflatable cells 11. The inner-layer inflatable units 1111 and the outer-layer inflatable units 1112 are bent to form the side walls of the inner-layer inflatable packaging body 1 and the outer-layer inflatable packaging body 2 and are and are arranged in a superposed manner.

Figure 6:
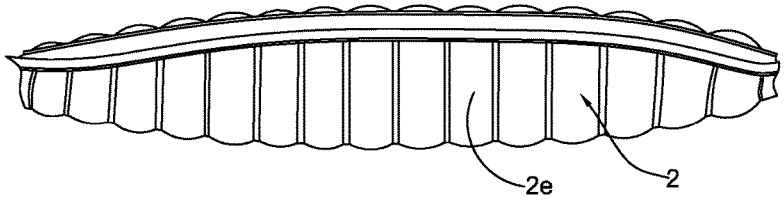
FIG. 6 is a schematic view of the multilayer air pack device according to the first preferred embodiment of the present invention, illustrating the bottom structure of the multilayer air pack device.

For example, in this preferred embodiment, the inner-layer inflatable packaging body 1 forms an inner front side wall 1*a*, an inner back side wall 1*b* and an inner bottom side wall 1*e* and forms a receiving chamber 100 for receiving the packaged items. The outer-layer inflatable packaging body 2 forms an outer front side wall 2*a*, an outer back side wall 2*b* and an outer bottom side wall 2*e*. The inner front side wall 1*a* of the inner-layer inflatable packaging body 1 and the outer front side wall 2*a* of the outer-layer inflatable packaging body 2 are overlapped with each other; the inner back side wall 1*b* of the inner-layer inflatable packaging body 1 and the outer back side wall 2*b* of the outer-layer inflatable packaging body 2 are overlapped with each other; the inner bottom side wall 1*e* of the inner-layer inflatable packaging body 1 and the outer bottom side wall 2*e* of the outer-layer inflatable packaging body 2 are overlapped with each other; so that each side walls of the multilayer air packaging device of the present invention form a multilayer structure. As shown in FIG. 6 of the drawings, the inflatable main body 10 is heat-sealed along a sealing line 116 and a sealing line 117 provided on two ends of the inflatable main body 10, so that the inflatable main body 10 has a head-to-tail ligation. It is worth mentioning that the inner-layer inflatable packaging body 1 forms an inner bag having the receiving chamber 100 and the outer-layer inflatable packaging body 2 also forms an outer bag having a receiving space according to the preferred embodiment of the present invention. The inner-layer inflatable packaging body 1 is extended to the receiving space of the outer bag formed by the outer-layer inflatable packaging body 2, thereby forming a bag-in-bag structure. Of course, the present invention is not limited in this aspect, and in practical applications, other structures can be used instead of forming a fully regular bag structure.

Thus, in this preferred embodiment of the present invention, the inner-layer inflatable units 1111 of the inner-layer inflatable packaging body 1 are arranged in a laminated manner with the outer-layer inflatable packaging body 2 and the outer-layer inflatable units 1112, thereby enhancing the air cushioning performance of the multilayer air packaging device. The inner-layer inflatable units 1111 of the inner-layer inflatable packaging body 1 and the outer-layer inflatable units 1112 of the outer-layer inflatable packaging body 2 are laminated with each other so as to form a cushioning space between the inner-layer inflatable units 1111 and the outer-layer inflatable units 1112. Therefore, the impact stress applied to the outer-layer inflatable units 1112 via the cushioning space is not directly transmitted to the packaged items, instead, a predetermined cushioning effect is provided to the outer-layer inflatable units 1112 through the cushioning space. Then the inner-layer inflatable units 1111 further provide cushioning effects and effectively disperse the impact stress.

When the outer-layer inflatable units 1112 is applied with the impact stress, air within the outer-layer inflatable units 1112 is temporarily distributed to the inner-layer inflatable units 1111, while the cushioning recovery force of the inner-layer inflatable units 1111 causes the air return to the outer-layer inflatable units 1112 so as to restore the outer-layer inflatable units 1112 to the initial state, thereby ensuring the air not being concentrated in a particular area. The outer-layer inflatable units 1112 and the inner-layer inflatable units 1111 are overlapped with each other so as to enhance a recovery performance, thereby efficiently providing the cushioning performance.

In some embodiments, for example, the inner-layer inflatable packaging body 1 is integrally connected to the outer-layer inflatable packaging body 2 by one or more interconnecting portions 30, so that when the packaged items are packaged, the packaged items are retained in position so as to enhance the air cushioning performance of the multilayer air packaging device. As shown in FIG. 1 of the drawings, the interconnecting portion 30 is forms between two lines of the bending seams 104 to form an inflatable structure and to enhance the top portion air cushioning performance of the multilayer air packaging device. One skilled in the art will understand that in other embodiments, the multilayer air packaging device of the present invention also have no apparent interconnecting portions 30. In other words, in other embodiment, the inner-layer inflatable units 1111 and the outer-layer inflatable units 1112 are integrally formed by bending.

When the packaged items are stored in the multilayer air packaging device of the present invention and the device is waggled by being applied to the impact force, because of the pulling effect of the outer-layer inflatable packaging body 2, the packaged items are not concentrated at a certain local position. Specifically, when the packaged items are about to be waggled to a right side corner, a left side of the inner-layer inflatable packaging body 1 of the multilayer air packaging device has an pulling force effect on the packaged items to return the packaged items to the initial position as the inner-layer inflatable packaging body 1 is connected to the outer-layer inflatable packaging body 2 located on the outer side. In other words, when the packaged items are stored in the inner-layer inflatable packaging body 1 of the multilayer air Packaging device, the packaged items are tend to be remained on the fixed position and remain a predetermined distance with the outer-layer inflatable packaging body 2 located on the outer side instead of directly contacting, so that the impact stress applied on the outer-layer inflatable packaging body 2 located on outer side is uniformly dispersed by the sealing chamber instead of directly being transferred to the packaged items by the sealing chamber of the outer-layer inflatable packaging body 2.

On the other hand, since the inner-layer inflatable packaging body 1 of the present invention is fixedly connected to the outer-layer inflatable packaging body 2 on the outer side, the cushioning space between the inner-layer inflatable packaging body 1 and the outer-layer inflatable packaging body 2 has a predetermined amount of air. When the outer-layer inflatable packaging body 2 formed by the inflatable three-dimensional package body is shook and impacted, the cushioning space between the inner-layer inflatable packaging body 1 and the outer-layer inflatable packaging body 2 and the predetermined amount of air also form one-layer of air chamber structure 3, thereby facilitating the cushioning effect. The cushioning space between the inner-layer inflatable packaging body 1 and the outer-layer inflatable packaging body 2 and the predetermined amount of air separates the packaged items forms the sealing chamber of the outer-layer inflatable packaging body 2, so that the impact force applied on the sealing chamber of the outer-layer inflatable packaging body 2 is prevented from directly being transmitted to the packaged items. Therefore, because of the air cushioning effect between the inner-layer inflatable packaging body 1 and the outer-layer inflatable packaging body 2, the two-layer inflatable packaging body enhances the air cushioning performance of the multilayer air Packaging device.

In addition, the outer-layer inflatable packaging body 2 and end inflatable unit 1113 of two end portions of the inner-layer inflatable packaging body 1 are connected by an end connecting seam 114. An inner connecting seam 115 is provided on the inner-layer inflatable packaging body 1, wherein the inner connecting seam 115 seals and connects side cushioning units 1114, so that the side cushioning unit 1114 and the end inflatable unit 1113 provide the cushioning space, thus the side portion of the inflatable units also form laminated structure so as to have a strong elastic restoring force, thereby enhancing the cushioning performance of the side portion of the multilayer air packaging device.

The inner-layer inflatable packaging body 1 and the outer-layer inflatable units 1112 and the inner-layer inflatable units 1111 of the outer-layer inflatable packaging body 2 on the outer side can have the substantially the same structure and also can have different shapes and sizes. For example, in the preferred embodiment of the present invention, as shown in FIG. 1 to FIG. 4 of the drawings, the sub-inflatable cells 111 of the inner-layer inflatable packaging body 1 and the sub-inflatable cells 111 of the outer-layer inflatable packaging body 2 have different air chamber structure. More specifically, the inner-layer inflatable units 1111 of the inner-layer inflatable packaging body 1 is further divided into a plurality of branch inflatable units 1111*i* by a branch dividing seam 105, thus one outer-layer inflatable units 1112 of the outer-layer inflatable packaging body 2 corresponds to the plurality of the branch inflatable units 1111*i* formed by the inner-layer inflatable units 1111 of the inner-layer inflatable packaging body 1. For example, in the example shown in the drawings, each of the inner-layer inflatable units 1111 is divided into two branch inflatable units 1111*i* by one branch dividing seam 105, thus one outer-layer inflatable units 1112 of the outer-layer inflatable packaging body 2 corresponds to two branch inflatable units 1111*i* formed by the inner-layer inflatable units 1111 of the inner-layer inflatable packaging body 1.

In the above embodiment, in other words, the outer-layer inflatable packaging body 2 forms a large-diameter air chamber structure and the inner-layer inflatable packaging body 1 forms a smaller-diameter air chamber structure, so that the outer-layer inflatable packaging body 2 and the inner-layer inflatable packaging body 1 forms a multi-layer arrangement of the air chamber structure and each layer of air chambers provides different levels of cushioning effect. Specifically, the outer-layer inflatable packaging body 2 provides a cushioning effect by the large-diameter air chamber, the air and space between the outer-layer inflatable packaging body 2 and the inner-layer inflatable packaging body 1 provides a cushioning effect and the inner-layer inflatable packaging body 1 provides a cushioning effect by the small-diameter air chamber, so that the multilayer air packaging device provides a multi-level of cushioning performance.

It is worth mentioning that one skilled in the art will understand that in the multilayer air Packaging device of the present invention, the outer-layer inflatable packaging body 2 also can have a small-diameter air chamber structure and the inner-layer inflatable packaging body 1 can also have a large-diameter air chamber. Alternatively, the inner-layer inflatable packaging body 1 and the outer-layer inflatable packaging body 2 both have mixed small-diameter air chambers and large-diameter air chambers and are alternately arranged as desired.

Figure 7:
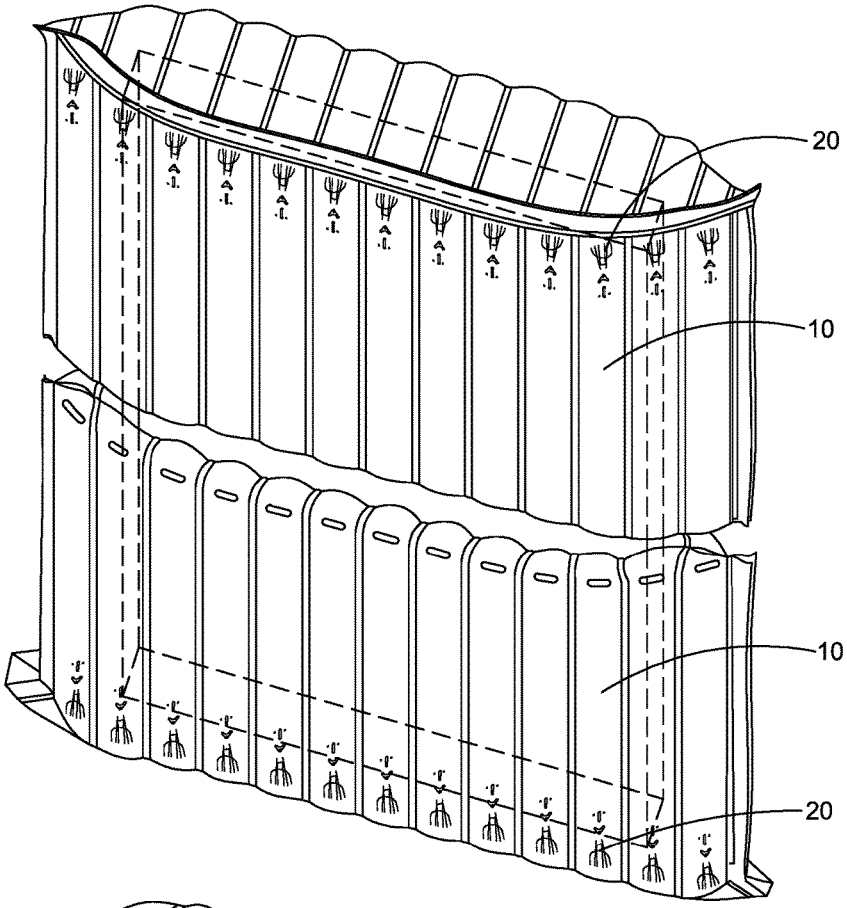
FIG. 7 is a perspective view of the multilayer air Packaging device according to the above first preferred embodiment of the present invention, wherein the multilayer air Packaging device is applied to a packaged item.
Figure 8:
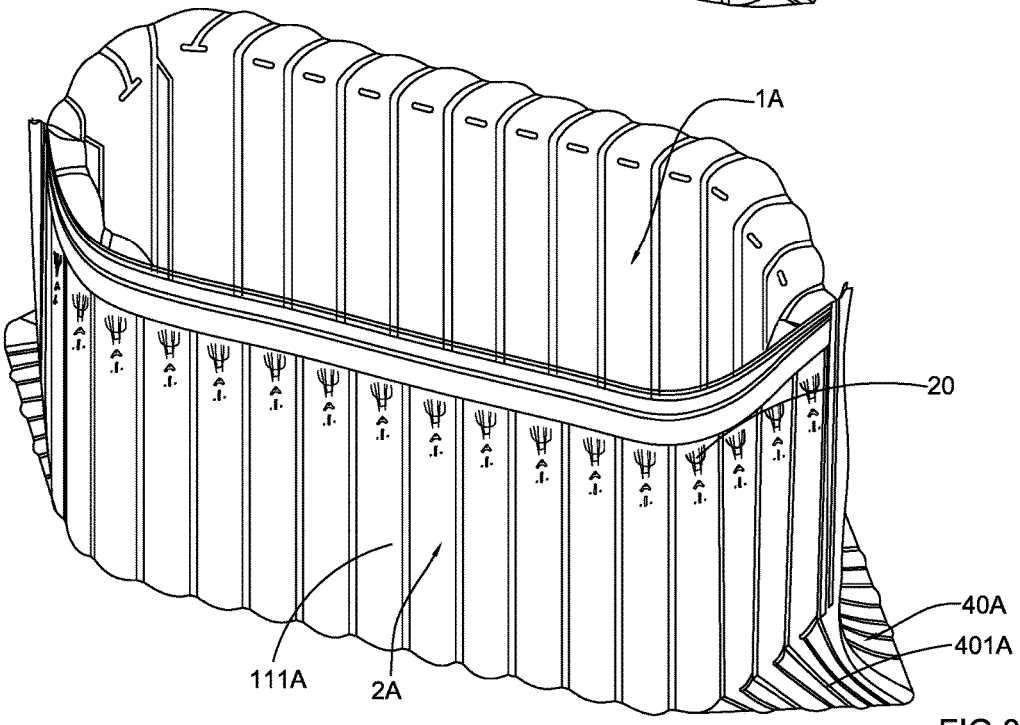
FIG. 8 is a perspective view of a multilayer air Packaging device according to a second preferred embodiment of the present invention.
Figure 9:
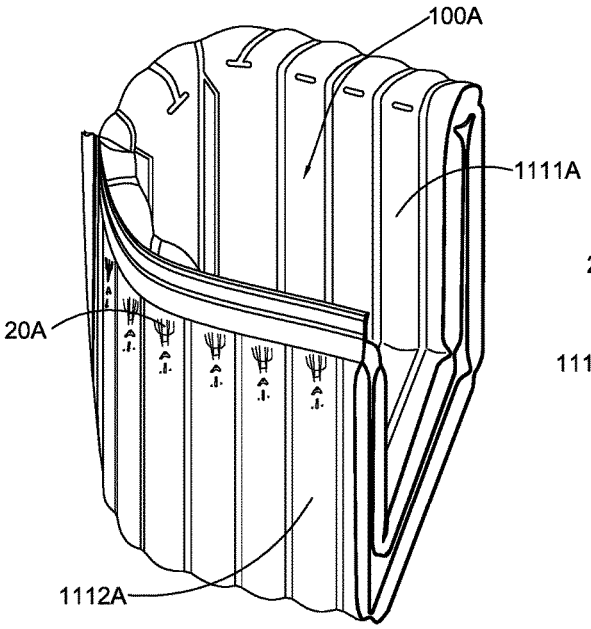
FIG. 9 is a sectional view of a multilayer air Packaging device according to the above second preferred embodiment of the present invention.
Figure 10:
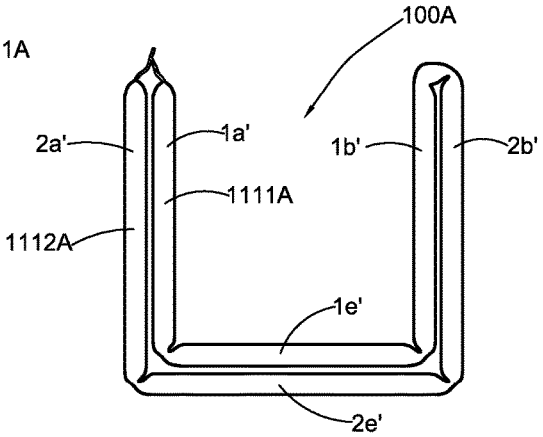
FIG. 10 is a sectional view of FIG. 9.
Figure 11:
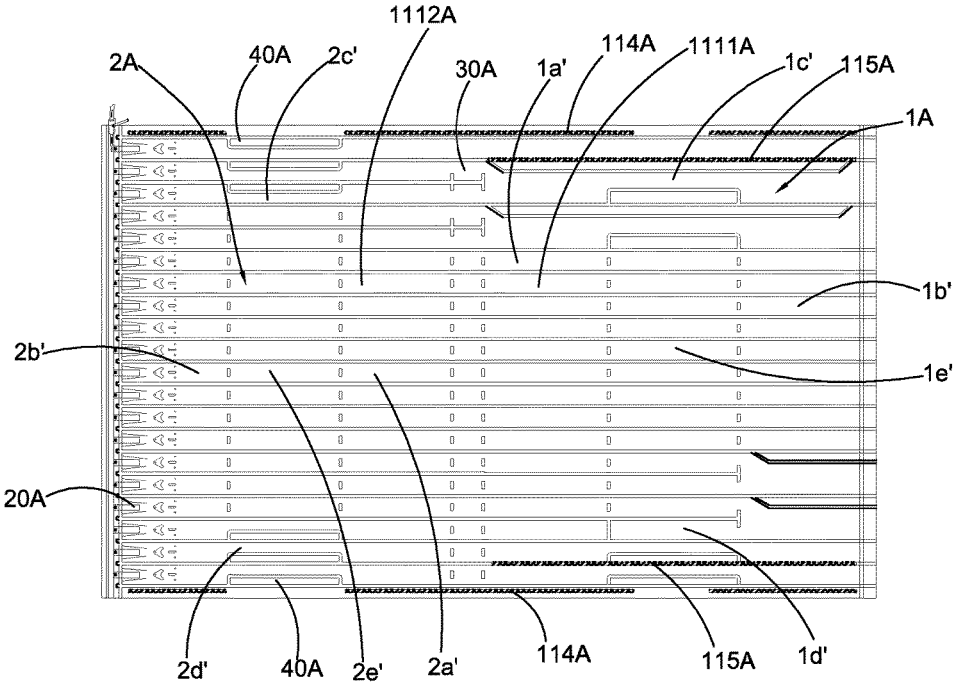
FIG. 11 is a schematic view of the multilayer air pack device according to the second preferred embodiment of the present invention, wherein the multilayer air pack device is not inflated and is unfolded.
Figure 12:
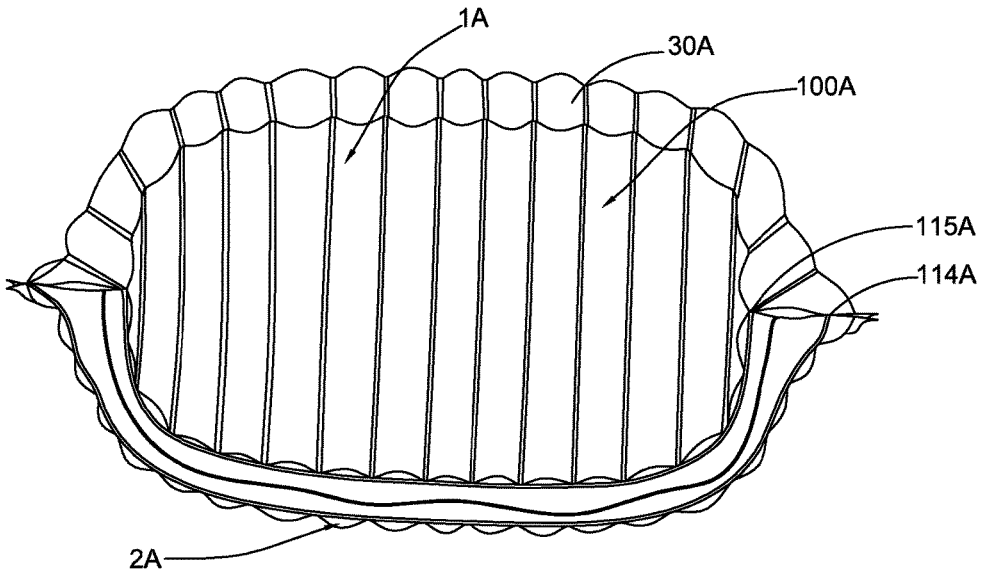
FIG. 12 is a schematic view of the multilayer air pack device according to the second preferred embodiment of the present invention, illustrating the top structure of the multilayer air pack device.
Figure 13:
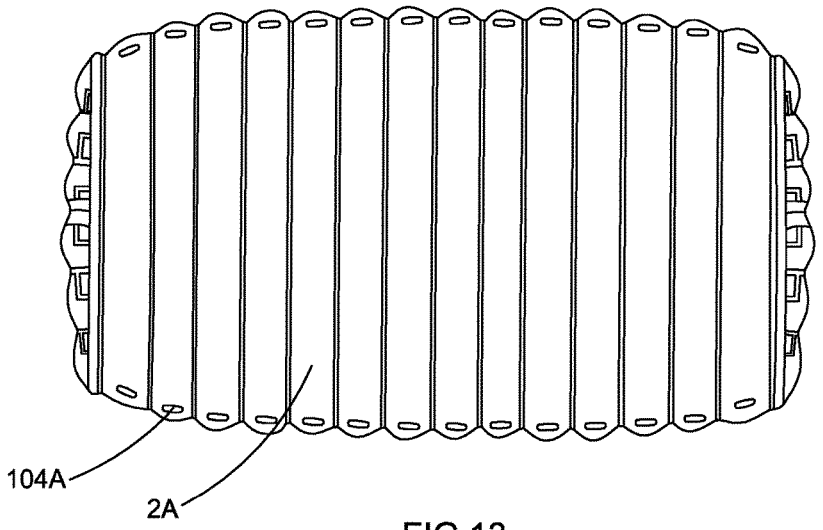
FIG. 13 is a schematic view of the multilayer air pack device according to the second preferred embodiment of the present invention, illustrating the bottom structure of the multilayer air pack device.
Figure 14:
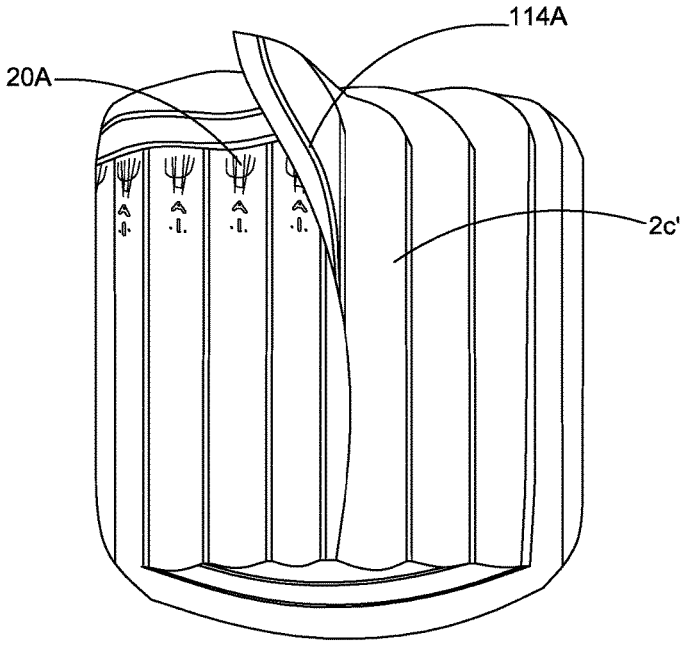
FIG. 14 is a schematic view of the multilayer air pack device according to the second preferred embodiment of the present invention, illustrating the lateral structure of the multilayer air pack device.
Figure 15:
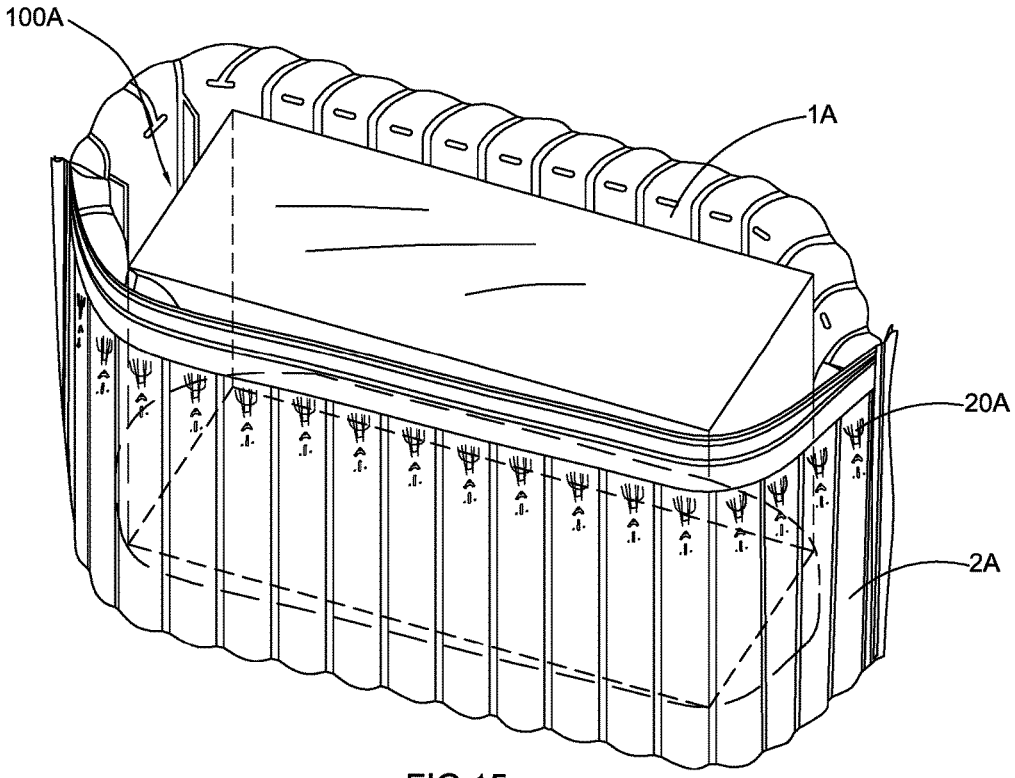
FIG. 15 is a perspective view of the multilayer air Packaging device according to the above second preferred embodiment of the present invention, wherein the multilayer air Packaging device is applied to a packaged item.

As shown in FIG. 7 of the drawings, when the length of the air chamber of the bottom wall of the inner-layer inflatable packaging body 1 and the outer-layer inflatable packaging body 2 are relatively shorter, while the length of the air chamber of the side wall thereof are relatively longer, the multilayer air packaging device is adapted to package flat or thin items. In practical applications, it is also possible to use a plurality of the multilayer air packaging devices to package the packaged items. For example, two multilayer air packaging devices package the packaged items in a sleeve-like manner.

Referring to FIG. 8 to FIG. 15 of the drawings, a multilayer air packaging device according to a second preferred embodiment of the present invention is illustrated, wherein the multilayer air packaging device in the second preferred embodiment has a similar structure with the multilayer air packaging device in the first preferred embodiment and the multilayer air packaging device in the second preferred embodiment is more suitable to be used to package square shaped packaged items.

Similarly, the multilayer air packaging device in the second preferred embodiment comprises an inner-layer inflatable packaging body 1A and an outer-layer inflatable packaging body 2A, wherein the inner-layer inflatable packaging body 1A and the outer-layer inflatable packaging body 2A are overlapped with each other to enhance a cushioning performance of a peripheral wall of the multilayer air packaging device. The inner-layer inflatable packaging body 1A and the outer-layer inflatable packaging body 2A can be implemented as a separated inflatable structure respectively and are connected to each other by such as heat-seal connection so as to form an entire connected structure. Also the inner-layer inflatable packaging body 1A and the outer-layer inflatable packaging body 2A can be implemented as an integrated structure. In the preferred embodiment of the present invention, take the integrated structure as an example, the inner-layer inflatable packaging body 1A and the outer-layer inflatable packaging body 2A are integrally formed by an inflatable main body 10A. Of course, the whole structure which is formed by the separate inner-layer inflatable packaging body 1A and the separate outer-layer inflatable packaging body 2A also has a multi-layer structure, thereby enhancing the cushioning performance of the multilayer air packaging device.

In this preferred embodiment, an inner-layer inflatable unit 1111A of the inner-layer inflatable packaging body 1A forms an inner front side wall 1*a*', an inner back side wall 1*b*', an inner left side wall 1*c*', an inner right side wall 1*d*' and an inner bottom side wall 1*e*' and forms a receiving chamber 100A for receiving the packaged items. An outer-layer inflatable unit 1112A of the outer-layer inflatable packaging body 2A forms an outer front side wall 2*a*', an outer back side wall 2*b*', an outer left side wall 2*c*', an outer right side wall 2*d*' and an outer bottom side wall 2*e*'. The inner front side wall 1*a*', the inner back side wall 1*b*', the inner left side wall 1*c*', the inner right side wall 1*d*' and the 1*e*' of the inner-layer inflatable packaging body 1A are respectively overlapped with the outer front side wall 2*a*', the outer back side wall 2*b*', the outer left side wall 2*c*, the outer right side wall 2*d*' and the outer bottom side wall 2*e*' of the outer-layer inflatable packaging body 2A so that each side walls of the multilayer air packaging device of the present invention form a multilayer structure.

It is worth mentioning that each of the inner-layer inflatable packaging body 1A and the outer-layer inflatable packaging body 2A further comprises two folding units 40A respectively corresponding to two corners of the inflated multilayer air packaging device, so that the corner position of the multilayer air packaging device is easy to be folded and is facilitate the formation of the three-dimensional configuration. Moreover, the bottom wall is respectively arranged at right angles to the four peripheral walls, so that a regular rectangular or square shaped receiving space is formed among the bottom wall and the four peripheral walls. The folding units 40A can be protruded outwardly so as to be inserted into the multilayer air packaging device. The arrangement of the folding units 40 ensures that the inner-layer inflatable packaging body 1A forms the inner left side wall 1*c*' and the inner right side wall 1*d*' and the outer-layer inflatable packaging body 2A forms the outer left side wall 2*c*' and outer right side wall 2*d*'; and these side walls respectively form a substantially right angle with the adjacent bottom wall, the front side wall and the back side wall; so that the entire multilayer air Packaging device is suitable to receive substantially square shaped packaged items.

Each of the folding units 40A is provided with a plurality of air blocking seams 401A corresponding to the sub-inflatable cells 111A, wherein the air blocking seams 401A reduce the amount of the inflated air of corresponding sub air chamber units 411A, thereby facilitating the folding of the entire folding unit 40A. While the air blocking seams 401A can be formed by heat sealing and the shape, the size and the location thereof are not limited. For example, the air blocking seams 401A can be a plurality of transversely or longitudinally arranged heat sealing lines or heat sealing blocks.

According to other embodiment, the folding units 40A can be uninflation units which cannot be inflated while the air distribution is achieved by transversely communicating channel between the sub-inflatable cells. In addition, the sub-inflatable cells of the inner-layer inflatable packaging body 1A and the outer-layer inflatable packaging body 2A can have different diameters to fit the shape and size of the items to be packaged. Furthermore, the sub-inflatable cells with different diameters can achieve multi-level cushion, thereby enhancing the air cushioning performance of the entire multilayer air Packaging device. In this preferred embodiment, the side portion of the inner-layer inflatable packaging body 1A has large-diameter air chambers, so that the inner wall of the side portion of the inner-layer inflatable packaging body 1A is substantially arc-shaped, thereby fitting to the packaged items.

Figure 16:
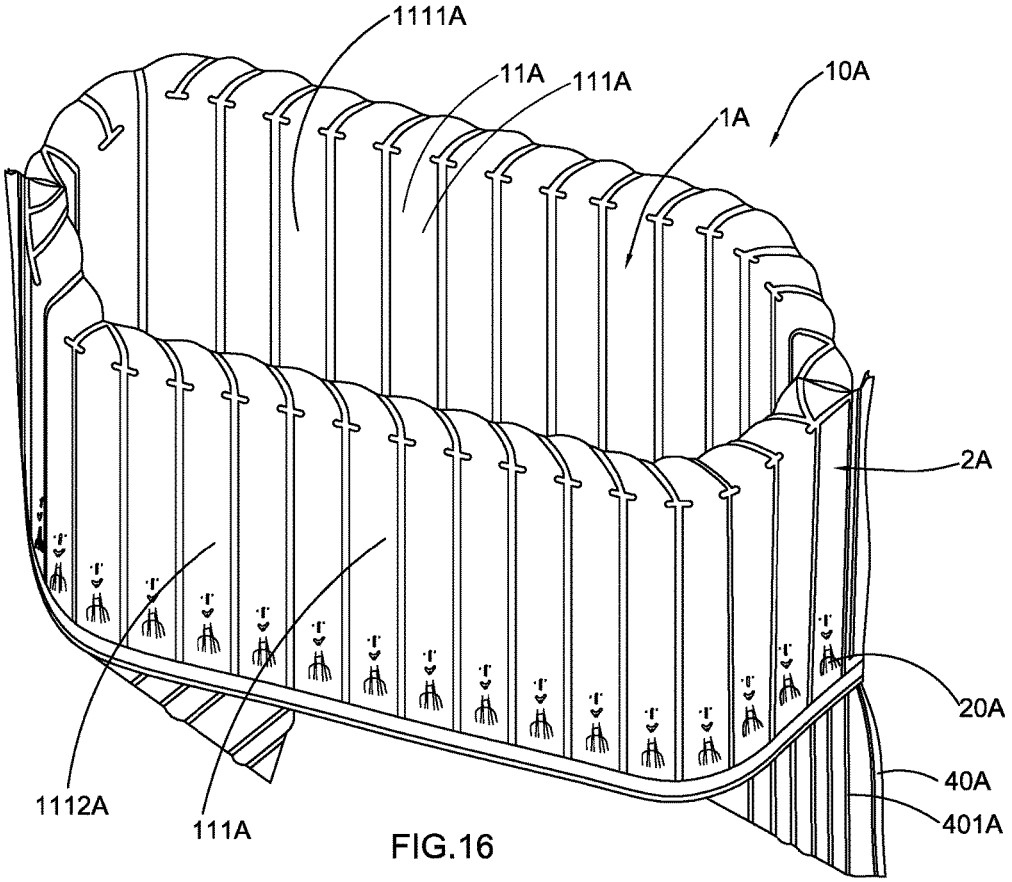
FIG. 16 is a perspective view of an alternative mode of a multilayer air Packaging device according to the second preferred embodiment of the present invention.
Figure 17:
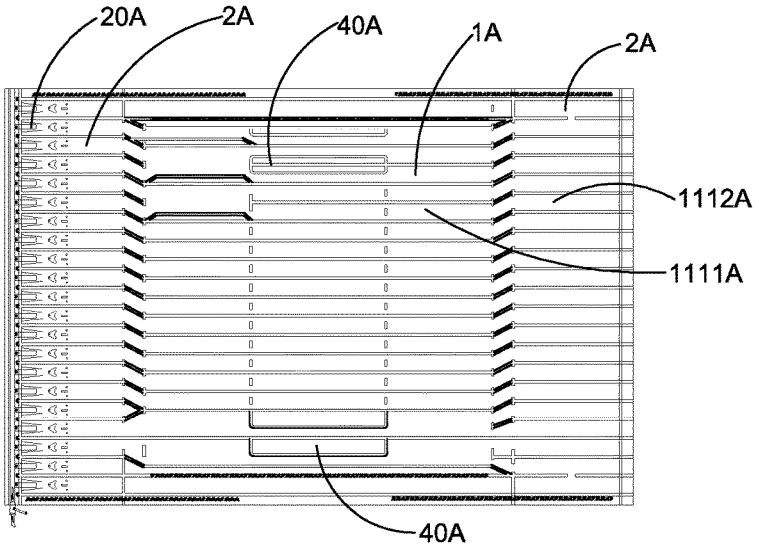
FIG. 17 is a schematic view of the multilayer air pack device according to the above preferred embodiment of the present invention, wherein the multilayer air pack device is not inflated and is unfolded.

Referring to FIG. 16 to FIG. 17 of the drawings, a multilayer air packaging device according to an alternative mode of the second preferred embodiment of the present invention is illustrated, wherein the outer-layer inflatable packaging body 2A does not form an outer bottom side wall, so that only four sides of the multilayer air packaging device form a two-layer structure. One skilled in the art will understand that according to the spirit of the present invention, the match of the side walls of the inner-layer inflatable packaging body 1A and the outer-layer inflatable packaging body 2A can also be other alternatives such as adding or reducing certain side wall. In other embodiment, a top side wall can be formed as a lid structure of the multilayer air packaging device.

In addition, the outer-layer inflatable units 1112A of the outer-layer inflatable packaging body 2A and the inner-layer inflatable unit 1111A of the inner-layer inflatable packaging body 1A also can form incompletely overlapped structure. In other words, the dividing seam 103A is not extended along a straight line, while a connecting portion between the outer-layer inflatable units 1112A of the outer-layer inflatable packaging body 2A and the inner-layer inflatable unit 1111A of the inner-layer inflatable packaging body 1A has a twist, such as vertical or inclined or curved transition, so that the overlapped outer-layer inflatable units 1112A and the inner-layer inflatable units 1111A form a staggered structure.

In addition, the position of the dividing seam 103A of the inner-layer inflatable packaging body 1A is uninflated and has a weak air cushioning performance, while the outer-layer inflatable packaging body 2A corresponding to the position of the dividing seam 103A of the inner-layer inflatable packaging body 1A is the inflatable structure formed by the outer-layer inflatable units 1112A and the inflatable structure formed by the outer-layer inflatable units 1112A has a stronger inflatable structure. Similarly, the diving seam 103A of the outer-layer inflatable packaging body 2A is uninflated and has a weak air cushioning performance, while the inner-layer inflatable packaging body 1A corresponding to the position of the diving seam 103A of the outer-layer inflatable packaging body 2A is the inflatable structure formed by the inner-layer inflatable units 1111A and the inflatable structure formed by the inner-layer inflatable units 1111A has a stronger inflatable structure. The staggered and laminated inner-layer inflatable packaging body 1A and outer-layer inflatable packaging body 2A ensure that the air cushioning performance of each of the sides of the entire multilayer air Packaging device is enhanced and each of the sides have substantially uniform cushioning performance.

It is worth mentioning that the above-mentioned various seams such as dividing seams, bending seams, transition seams and inner connecting seam both can be formed by heat sealing process. Wherein two or more layers of flexible films are heat-seat together by the heat sealing process.

Figure 18:
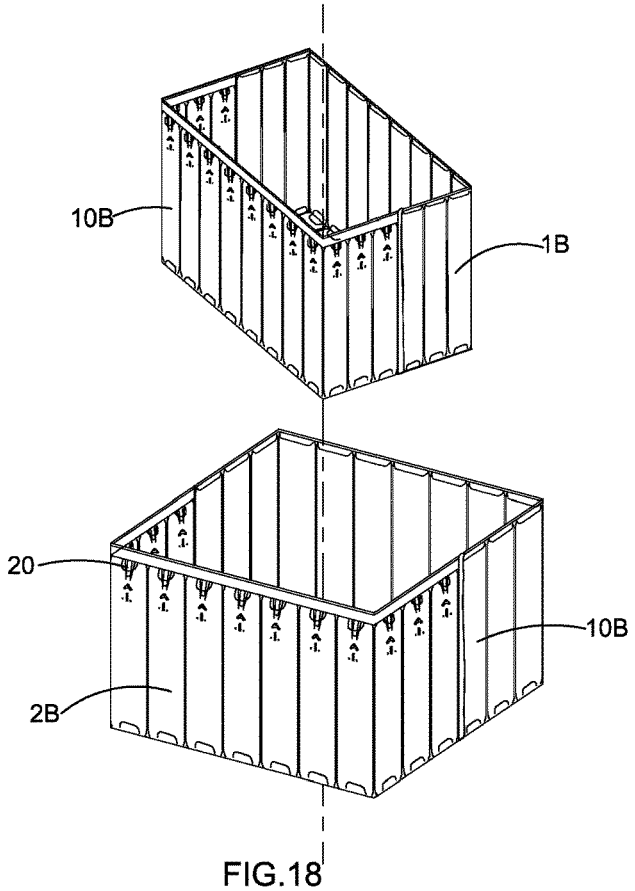
FIG. 18 is an exploded view of a multilayer air Packaging device according to a third preferred embodiment of the present invention.
Figure 19:
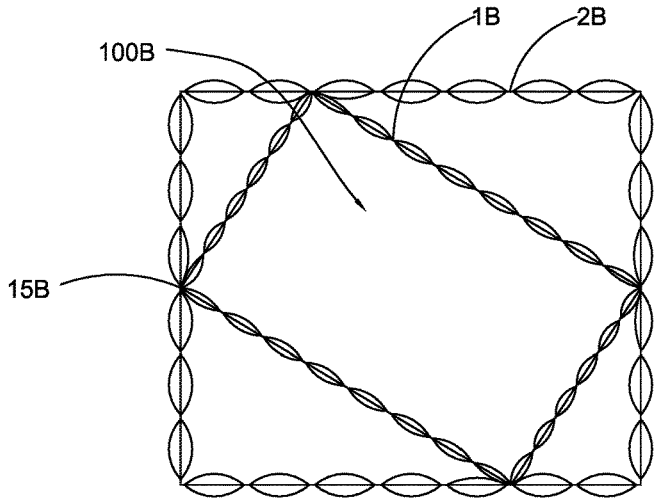
FIG. 19 is a perspective view of the multilayer air Packaging device according to the above third preferred embodiment of the present invention.

Referring to FIG. 18 to FIG. 19 of the drawings, a multilayer air packaging device according to a third preferred embodiment of the present invention is illustrated, wherein the multilayer air packaging device comprises an inner-layer inflatable packaging body 1B and an outer-layer inflatable packaging body 2B. The inner-layer inflatable packaging body 1B and the outer-layer inflatable packaging body 2B are respectively formed by a inflatable main body 10B and two inflatable main body 10B are heat sealed together by a heat sealing seam 15B so as to form a laminated structure.

As shown in the drawings, the laminated structure of the inner-layer inflatable packaging body 1B and the outer-layer inflatable packaging body 2B can be various. For example, the inner-layer inflatable packaging body 1B and the outer-layer inflatable packaging body 2B have substantially same shapes so as to overlap with each other. The inner-layer inflatable packaging body 1B and the outer-layer inflatable packaging body 2B can also be staggered with each other as shown in FIG. 19. On other words, the connecting ribs between side walls of the inner-layer inflatable packaging body 1B are not overlapped with the connecting ribs between side walls of the outer-layer inflatable packaging body 2B, so that each corners form a triangular support structure, thereby enhancing air cushioning performance.

Figure 20:
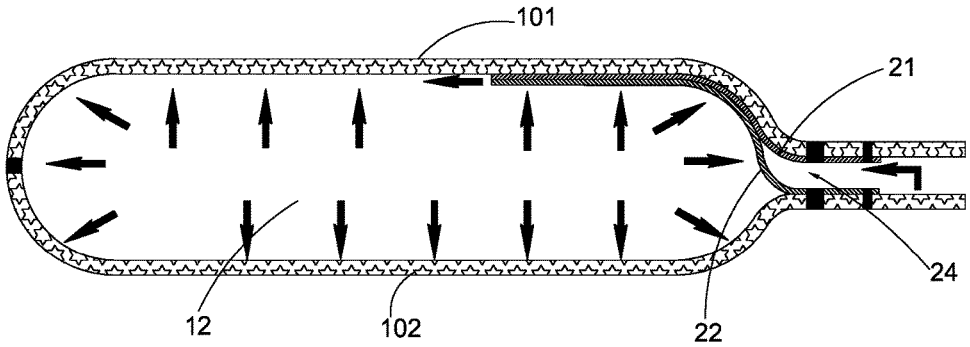
FIG. 20 is a schematic view of an inflating valve of the multilayer air Packaging device according to the above first preferred embodiment of the present invention.
Figure 21:
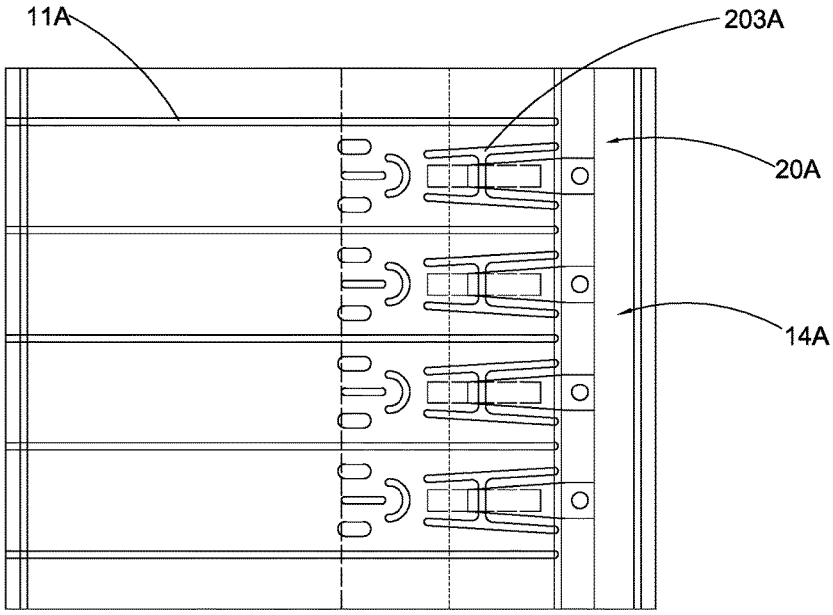
FIG. 21 to FIG. 23B are schematic views of another inflating valve of the multilayer air Packaging device according to the above first preferred embodiment of the present invention.
Figure 22:
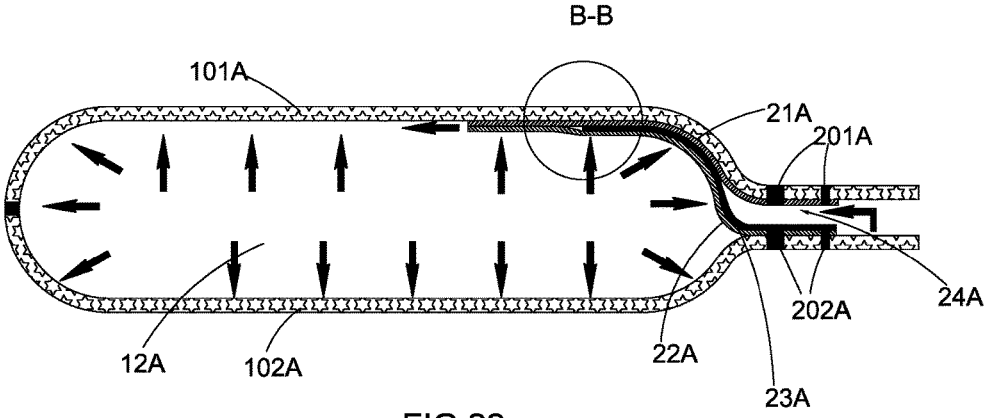
Figure 23A:
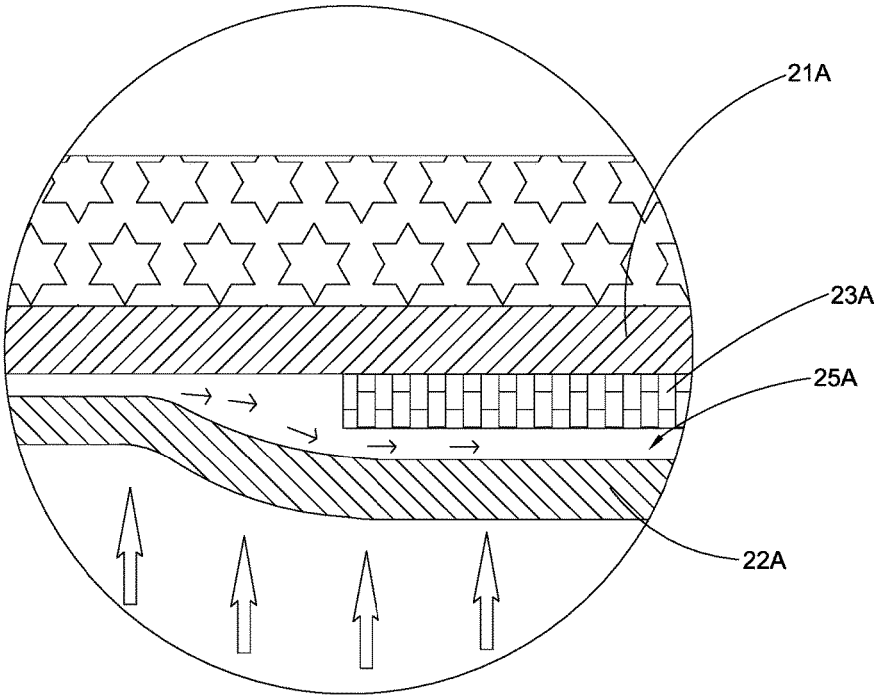
Figure 23B:
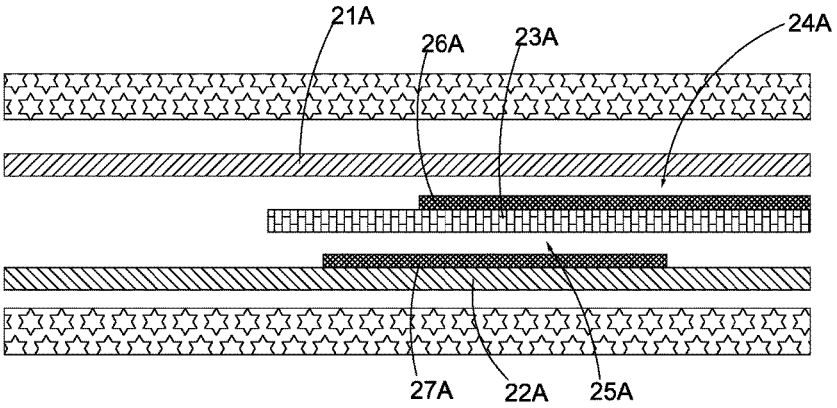
Figure 24:
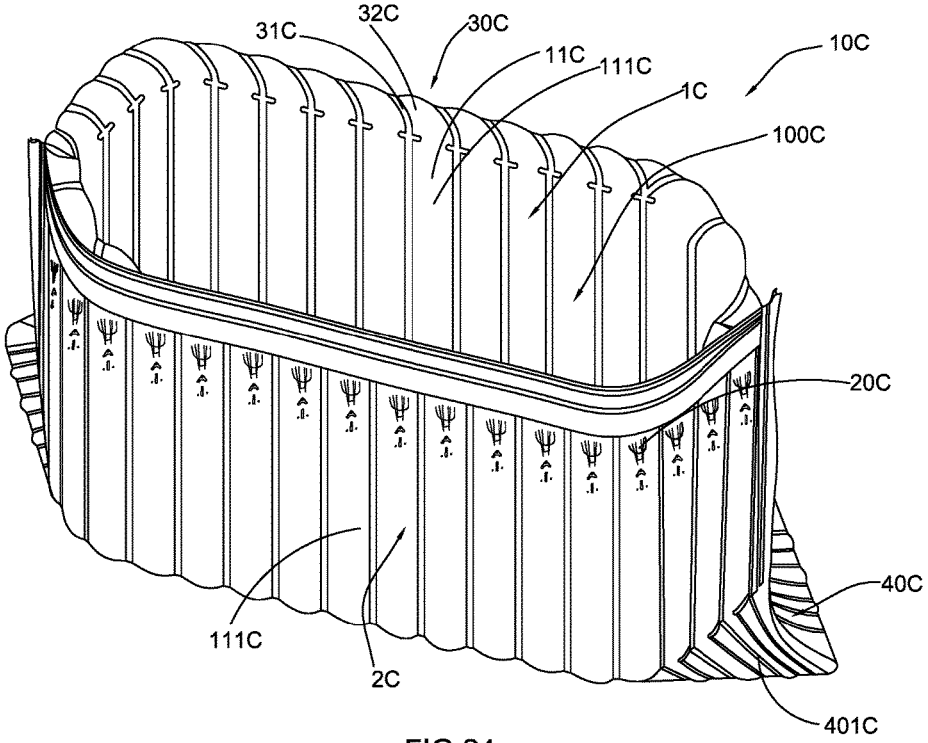
FIG. 24 is a perspective view of a staggered laminated air packaging device according to a fourth preferred embodiment of the present invention.
Figure 25:
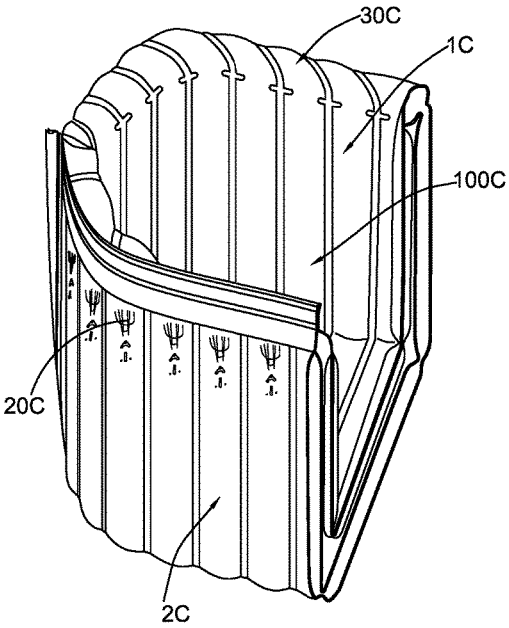
FIG. 25 is a sectional view of the staggered laminated air packaging device according to the above fourth preferred embodiment of the present invention.
Figure 26:
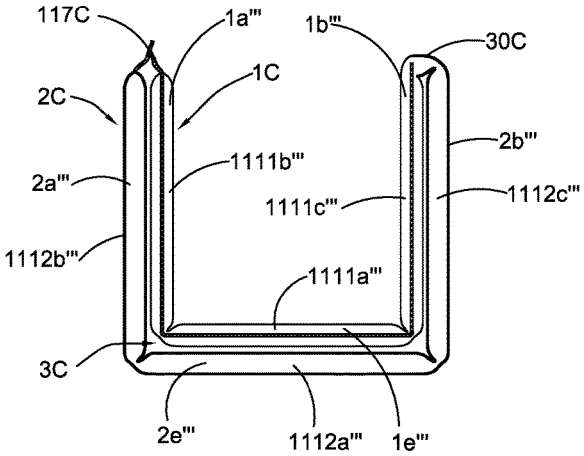
FIG. 26 is a sectional view of FIG. 25.
Figure 27:
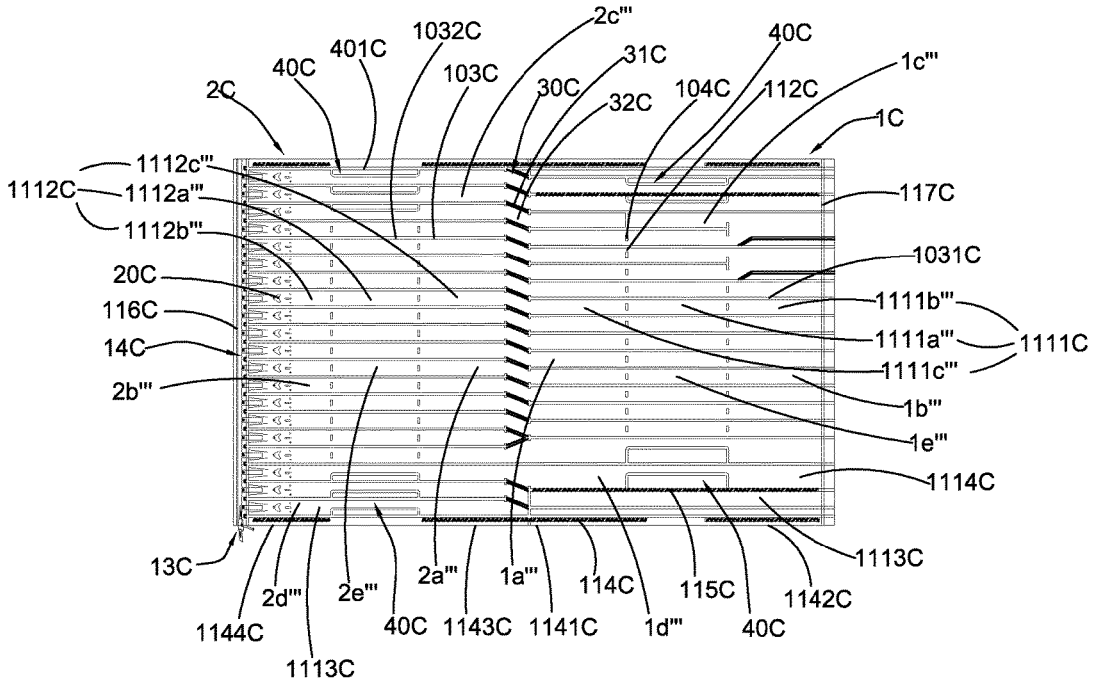
FIG. 27 is a schematic view of the staggered laminated air packaging device according to the fourth preferred embodiment of the present invention, wherein the staggered laminated air packaging device is not inflated and is unfolded.
Figure 28:
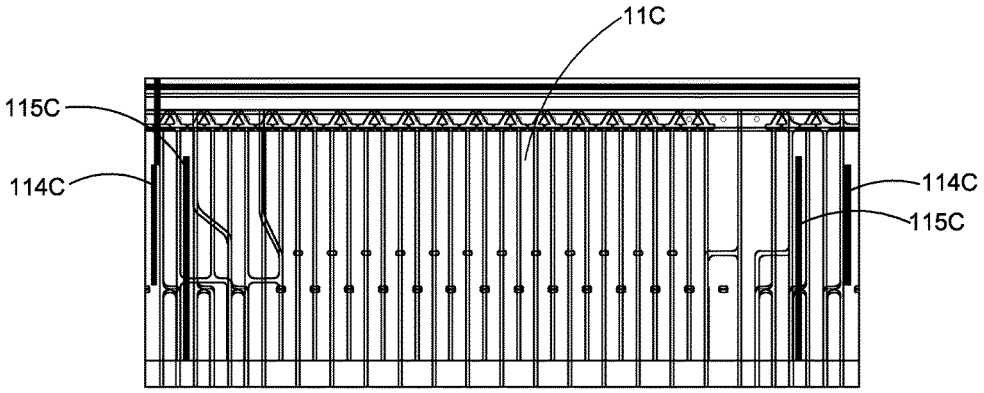
FIG. 28 is a schematic view of the staggered laminated air packaging device according to the fourth preferred embodiment of the present invention, illustrating the lateral structure of the staggered laminated air packaging device, wherein the staggered laminated air packaging device is folded and is heat sealed.
Figure 29A:
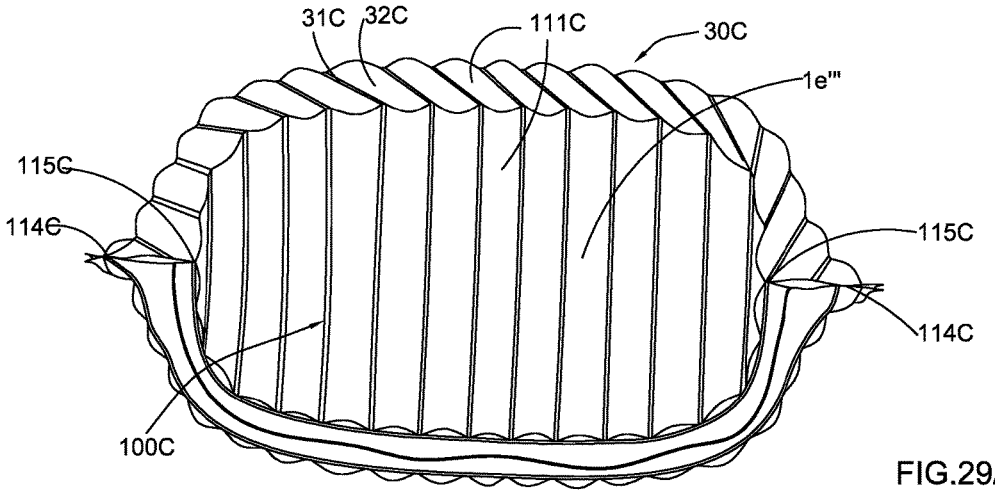
FIG. 29A is a perspective view of the staggered laminated air packaging device according to the fourth preferred embodiment of the present invention, illustrating the top structure of the staggered laminated air packaging device.
Figure 29B:
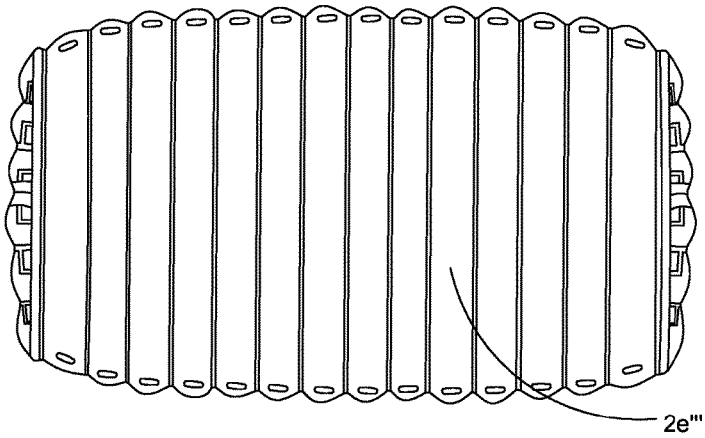
FIG. 29B is a schematic view of the staggered laminated air packaging device according to the fourth preferred embodiment of the present invention, illustrating the bottom structure of the staggered laminated air packaging device.

As shown in FIG. 20, the inflating valve 20 is a non-return valve comprising two sealing films 21 and 22. The first and second sealing films 21, 22 are overlapped between the first chamber layer 101 and the second chamber layer 102, so as to form a four-layer structure. An air inflating channel 24 is formed between the two sealing films 21 and 22. Correspondingly, after the inflatable main body 10 is inflated with air, the two sealing films 21, 22 are bonded together, so as to seal the air bag the air inflating channel, so that air is sealed into the inflatable cavity 12 of the inflatable main body 10. If the inflatable main body 10 comprises more than one inflatable cell 11, more than one inflating valve 20 is correspondingly provided to each of the inflatable cells 11, so as to seal air into each corresponding inflatable cells 11. Specially, the first sealing film 21 is overlapped and bonded to the first chamber layer 101. The second sealing film 22 is overlapped and bonded to the second chamber layer 102. When the inflatable main body 10 is being inflated, air is guided into the air inflating channel 24 formed between the first sealing film 21 and the second sealing film 22. When the inflatable main body is full of air, the first sealing film 21 and the second sealing film 22 are adhered with each other, so as to seal the air inflating channel 24 of the inflatable main body. In addition, the air pressure in the inflatable main body apply to the two sealing films 21 and 22, so as to ensure the two sealing films 21 and 22 adhering with each other tightly, so as to avoid air from leaking through the inflating valve 20. In other words, the inflating valve 20 is a non-return valve, which allows air to enter into the inflatable main body 10 and avoid air from leaking out of the inflatable main body 10.

The forming of the air inflating channel 24 of the inflating valve 20 is realized by providing a blocking element between the two sealing films 21 and 22. When the two sealing films 21 and 22 and the first chamber layer 101 and the second chamber layer 102 are being sealing, due to the blocking device is provided, the two sealing films 21 and 22 are not entirely sealed together, so as to form the air inflating channel 24. According to one embodiment of the present invention, the blocking element can be high temperature durable ink.

Referring to FIG. 21 to FIG. 23B of the drawings, a multilayer air packaging device according to another alternative mode of the present invention is illustrated, which mainly illustrates the structure of another inflating valve 20A. The inflating valve 20A is a double non-return valve, so as to provide double sealing effect to the inflatable main body. The inflating valve 20A comprises a first sealing film 21A, a second sealing film 22A and a non-return sealing film 23A.

The first sealing film 21A and the second sealing film 22A are overlapped between the first chamber layer 101A and the second chamber layer 102A of the inflatable cell 11A. The first sealing film 21A and the second sealing film 22A are two thin flexible films overlapping with each other, which are made of plastic. Preferably, the first sealing film 21A and the second sealing film 22A are two same films.

Each of the first sealing films 21A and the second sealing films 22A has a first edge, i.e. a near edge extended to the exit of the inflating valve 20A of the inflatable cell 11A, and a second edge, i.e. A far edge extended into the inflatable cell. Preferably, the first edges and the second edges of the first sealing films 21A and the second sealing films 22A are respectively adjacent to each other.

According to this embodiment, the first edges of the first sealing films 21A are attached to the first chamber layer 101A. The first edges of the second sealing films 22A are attached to the second chamber layer 102A.

The non-return sealing film 23A overlaps with the first edges of the first sealing films 21A and the second sealing films 22A, so as to form an air inflating channel 24A between the first sealing film 21A and the non-return sealing film 23A, and to form a non-return channel 25A between the non-return sealing film 23A and the second sealing film 22A.

The air inflating channel 24A is arranged to be used to inflate air into the inflatable cavity 12A so as to fill the inflatable cell 11A until the air in the inflatable cavity 12A can make the seconds edges of the first sealing film 21A and the second sealing film 22A to be overlapped to seal and to close the air inflating channel 24A. According to this preferred embodiment of the present invention, if air is leaked through space between the second edges of the first sealing film 21A and the second sealing film 22A, the air in the inflatable cavity 12A is guided into the non-return channel 25A, so as to provide an air supplement and further seal the air inflating channel 24A, so as to enhance the sealing effect of the first sealing film 21A and the second sealing film 22A.

The air inflating channel 24A has two open ends which are a first open end and a second open end. A near open end is formed between the first edges of the first sealing film 21A and the first end of the corresponding non-return sealing film 23A. A second open end is extended to the second edge of the first sealing film 21A and the second edge of the corresponding second sealing film 22A, so as to communicate with the inflatable cavity 12A. Compressed air can be guided into the inflatable cavity 12A through the air inflating channel 24A.

It is worth mentioning that when the inflatable cell 11A is full of air, the pressure in the inflatable cavity 12A is press to the first sealing film 21A and the second sealing film 22A, so as to sealing the gap between the first sealing film 21A and the second sealing film 22A and seal the second open end of the air inflating channel 24A. In addition, the second edge of the first sealing film 21A and the second edge of the second sealing film 22A are sealed together due to surface tension.

The non-return sealing film 23A is thin flexible film made of plastic. Preferably, the non-return sealing film 23A, the first sealing film 21A and the second sealing film 22A are poly ethylene films. In addition, the thickness of each first chamber layer 101A and each second chamber layer 102A is greater than the thickness of the first sealing film 21A, the second sealing film 22A and the non-return sealing film 23A.

According to the preferred embodiment of the present invention, the length of the non-return sealing film 23A is smaller than the length of the first sealing film 21A and the second sealing film 22A, so that when the non-return sealing film 23A overlaps to the first edge of the first sealing film 21A and the second sealing film 22A, the second edge of the first sealing film 21A and the second edge of the second sealing film 22A are overlapped together. It is worth mentioning that the length of the non-return sealing film 23A is defined as the distance between the first edge of the non-return sealing film 23A and the second edge of the non-return sealing film 23A. The length of each first sealing film 21A is defined as the distance between the first edge of the first sealing film 21A and the second edge of the first sealing film 21A. The length of the second sealing film 22A is defined as the distance between the first edge of the second sealing film 22A and the second edge of the second sealing film 22A.

Correspondingly, the first edge of the first sealing film 21A and the first edge of the second sealing film 22A and the first edge of the non-return sealing film 23A are adjacent to each other. In addition, the first edge of the non-return sealing film 23A is bonded to the first edge of the second sealing film 22A.

The non-return channel 25A is form between the non-return sealing film 23A and the second sealing film 22A, wherein the non-return channel 25A has an open end facing the inflatable cavity 12A and a closed end facing the opening of the air valve. In other words, the first edge of the non-return channel 25A is the closed end and the second edge of the non-return channel 25A is the open end.

Correspondingly, while air in inflated into the non-return channel 25A through the open end, the non-return channel 25A is filled with air to product a pressure supplement, so as to further seal the air inflating channel 24A between the first sealing film 21A and the second sealing film 22A.

It is worth mentioning that while inflating air into the inflatable cavity 12A through the air inflating channel 24A, the flow direction of the air in the air inflating channel 24A is opposite to the flow direction of the air in the non-return channel 25A. Thus, air will not be filled into the non-return channel 25A. While air is leaked back from the inflatable cavity 12A to the non-return channel 25A, air enters into the non-return channel 25A, so as to generate a pressure supplement and further seal the air inflating channel 24A, so as to avoid leaking air. It is worth mentioning that before being leaked through the first open end of the air inflating channel 24A, the leaked air flows from the second end of the air inflating channel 24A to the second open end of the non-return channel 25A, so as to avoid the air being leaked. In addition, the non-return sealing film 23A and the first sealing film 21A are sealed together due to the surface tension, so as to seal the air inflating channel 24A.

In order to form the inflating valve 20A to the inflatable cell 11A, the inflating valve 20A further comprises a first seal joint portion 201 and a second seal joint portion 202. The first seal joint portion is provided to bond the first chamber layer 101A and the first sealing film 21A together at the opening of the air valve of the inflatable cell 11A. The second seal joint portion is used to bond the second chamber layer 102A, the non-return sealing film 23A and the second sealing film 22A together at the opening of the air valve of the inflatable cell 11A.

Correspondingly, the first edge of the first sealing film 21A is bonded to the first chamber layer 101A via the first seal joint portion 201. The second chamber layer 102A, the first edge of the second sealing film 22A and the first edge of the non-return sealing film 23A are bonded together via the second seal joint portion 202A. Preferably, two interval seal joint portions 201A are used to bond the first chamber layer 101A and the first sealing film 21A. Two interval second seal joint portions 202A are used to bond the second chamber layer 102A, the non-return sealing film 23A and the second sealing film 22A. It is worth mentioning that the first seal joint portion 201A and the second seal joint portion 202A not only can be heat sealing line, but also can be heat sealing which other shapes. In other words, the first edge of the first sealing film 21A and the first chamber layer 101A are sealed together via the seal joint portion 201A. The second chamber layer 102A and the first edge of the second sealing film 22A and the first edge of the non-return sealing film 22 are sealed together via the second seal joint portion 202A.

In order to keep a apace between the first sealing film 21A and the non-return sealing film 23A after being sealed, the inflating valve 20A further comprises a first heat resisting item 26A, which is formed between the first sealing film 21A and the non-return sealing film 23A, so as to ensure the air inflating channel 24A being formed. The first heat resisting item 26A is provided to avoid the first sealing film 21A and the non-return sealing film 23A being entirely bonded together during the process of heat sealing.

In detail, the first heat resisting item 26A is provided to the first edge of the first sealing film 21A, the first edge of the non-return sealing film 23A and the opening of the air valve of the inflatable cell 11A, so as to ensure the first end of the air inflating channel 24A being in an opening state.

In similar, in order to keep the space between the second sealing film 22A and the non-return sealing film 23A after the process of heat sealing, the inflating valve 20A further comprises a second heat resisting item 27A formed between the second sealing film 22A and the non-return sealing film 23A to ensure forming of the non-return channel 25A.

In detail, the second heat resisting item 27A is provided to the second edge of the second sealing film 22A and the second edge of the non-return sealing film 23A, so as to ensure the second end of the non-return channel 25A being in an opening state. It is worth mentioning that the first end of the non-return channel 25A is closed by the second seal joint portion 202.

According to the preferred embodiment of the present invention, the first heat resisting item 26A and the second heat resisting item 27A are two heat-resisting layers, which are coated to predetermined position of corresponding films, so as to avoid the films being attached together at the process of heat sealing. The first heat resisting item 26A is extended to the first end of the non-return sealing film 23A and faces to the first sealing film 21A. The second heat resisting item 27A is extended to an opposite side of the second end of the non-return sealing film 23A and faces to the second sealing film 22A, wherein the second heat resisting item 27A is not provided to the opposite side of the first end of the non-return sealing film 23A, thus, the first end of the non-return channel 25A can be closed by the second seal joint portion 202A. It is worth mentioning that the second heat resisting item 27A not only avoid the non-return sealing film 23A and the second sealing film 22A being attached together to ensure the second end of the non-return channel 25A being in an opening state, but also enhance the force between the non-return sealing film 23A and the first sealing film 21A, so as to close the air inflating channel 24A via surface tension.

The inflating valve 20A further comprises two side seal joint portions 203A, i.e. two third seal joint portions being used to attach the first sealing film 21A and the non-return sealing film 23A, so as to form side walls of the air inflating channel 24A. The width of the air inflating channel 24A is defined by the two side seal joint portions 203A. In detail, the two side seal joint portions 203A are two slant heat-sealing lines, so that the width of the air inflating channel 24A decreases progressively from the inflatable cavity at the opening of the air valve. In other words, a first opening end, i.e. A near opening end of the air inflating channel 24A is a bigger opening end communicating with the opening of the air valve. A second opening end, i.e. a far opening end of the air inflating channel 24A is a taper opening end communicating with the inflatable cavity 12A. The taper air inflating channel 24A further avoids air from being leaked to the opening of the air valve from the inflatable cavity 12A.

Preferably, the side seal joint portions 203A are extended from the first edge of the first sealing film 21A and the first edge of the second sealing film 22A to the second edge of the first sealing film 21A and the second edge of the second sealing film 22A. Thus, the side seal joint portions 203A are provided to the first end of the first sealing film 21A and the first end of the second sealing film 22A, and are attached together with the non-return sealing film 23A. The side seal joint portions 203A are provided to the second end of the first sealing film 21A and the second end of the second sealing film 22A and are attached together with the first sealing film 21A and the second sealing film 22A.

Correspondingly, in order to inflate into the inflatable cell 11A, a pump is inserted to the air inflating opening 13A to fill compressed air into the air inflating channel 24A, wherein the air inflating direction is from the first opening end of the air inflating channel 24A to the second opening end of the air inflating channel 24A. Thus, the inflatable cells 11A start to be inflated. The pressure of inflatable cavity 12A is enlarged to push the first chamber layer 101A and the second chamber layer 102A. At the same time, the pressure acts on the first sealing film 21A and the second sealing film 22A, and particularly on the second end of the first sealing film 21A and the second end of the second sealing film 22A. After the inflatable cell 11A is fully filled with air, i.e. The maximum loading lever is reached, the pressure in the inflatable cavity 12A is big enough to seal the second end of the first sealing film 21A and the second end of the second sealing film 22A, so as to seal the second opening end of the air inflating channel 24A automatically. Then the pump is put out of the air inflating opening 13A.

While the second end of the first sealing film 21A and the second end of the second sealing film 22A are not entirely sealed together, it is likely that the air in the inflatable cavity 12A being leaked to the air inflating channel 24A. To avoid air from being leaked to the air inflating channel 24A, the non-return sealing film 23A is sealed to the first sealing film 21A to seal the second opening end of the air inflating channel 24A. In detail, the air inflow direction of the non-return channel 25A is opposite to the air inflating direction of the air inflating channel 24A. In addition, while the opening end of the non-return channel 25A being open, the second opening end of the air inflating channel 24A is closed. Thus, air enters from the opening end of the non-return channel 25A and is retained in the non-return channel 25A.

The non-return channel 25A is filled with air, so a pressure supplement is produced in the non-return channel 25A to further seal the air inflating channel 24A. Specially, the second opening end of the air inflating channel 24A between the first sealing film 21A and the non-return sealing film 23A is sealed. More specifically, the higher the pressure supplement in the non-return channel 25A is, the better the sealing effect of the non-return sealing film 23A is. In other words, while air is leaked from the inflatable cavity 12A to reduce the pressure of the inflatable cavity 12A, air enters into the non-return channel 25A to enhance the pressure of the non-return channel 25A. Thus, the total pressure of inflating, i.e. The sum of the pressure of the inflatable cavity 12A and the pressure of the non-return channel 25A remains unchanged. Thus, air enters into the non-return channel 25A from the inflatable cavity 12A enhance the sealing effect of the air inflating channel 24A.

Referring to FIG. 24 to FIG. 31 of the drawings, a staggered laminated air packaging device according to a fourth preferred embodiment of the present invention is illustrated. The staggered laminated air packaging device can be used to store packaged items, such as electronic products, food, medicine products, chemical materials, biological materials, plastics, ceramics, and Fast Moving Consumer Goods. As the staggered laminated air packaging device has cushion performance, so that the staggered laminated air packaging device is suitable to be used to provide air cushion performance for the packaged items. One skilled in the art will understand that the packaged items are not limited to the examples described above. The staggered laminated air packaging device of the present invention can also be applied into the package of other types of items according to actual needs.

Specifically, the staggered laminated air packaging device comprises two or more layers of inflatable packaging bodies which are overlapped with each other, thereby enhancing the cushioning performance of the entire air packaging device. One skilled in the art shall understand that the two or more inflatable packaging bodies can be implemented as a two-layer of inflatable packaging body, a three-layer of inflatable packaging body or more layers of inflatable packaging body. In this preferred embodiment, the two-layer of inflatable packaging body is illustrated as an example, wherein the two-layer of inflatable packaging body comprises an inner-layer inflatable packaging body 1C and an outer-layer inflatable packaging body 2C, wherein the inner-layer inflatable packaging body 1C and the outer-layer inflatable packaging body 2C are overlapped and staggered with each other so as to enhance the cushioning performance of the peripheral wall of the staggered laminated air packaging device.

The inner-layer inflatable packaging body 1C and the outer-layer inflatable packaging body 2C can be implemented as separated inflatable structures respectively and are connected to each other by a connection manner such as a heat-seal connection so as to form an entire structure. Also the inner-layer inflatable packaging body 1C and the outer-layer inflatable packaging body 2C can be implemented as an integrated structure. In the preferred embodiment of the present invention, take the integrated structure as an example, the inner-layer inflatable packaging body 1C and the outer-layer inflatable packaging body 2C are integrally formed by an inflatable main body 10C. Of course, the whole structure which is formed by the separate inner-layer inflatable packaging body 1C and the separate outer-layer inflatable packaging body 2C also has multi-layer structure, thereby enhancing the cushioning performance of the staggered laminated air packaging device.

In this preferred embodiment of the present invention, the inner-layer inflatable packaging body 1C and the outer-layer inflatable packaging body 2C are in a staggered laminated arrangement. More specifically, as shown in FIG. 45 of the drawings, the inflatable main body 10C comprises an inflatable cell inflatable cells 11C, wherein the inflatable cell inflatable cells 11C comprises a first chamber layer 101C and a second chamber layer 102C. The first chamber layer 101C and the second chamber layer 102C both can be implemented as one layer of flexible thin film. The first chamber layer 101C and the second chamber layer 102C overlap with each other to form an inflatable cavity 12C and to form at least one air inflating opening 13C. The air inflating opening 13C communicates with the inflatable cavity 12C so as to be used to inflate air into the inflatable cavity 12C. As shown in the drawings, two or more inflatable cells inflatable cells 11C are arranged side by side so as to form the inflatable main body 10C, wherein an inflating valve 20C is provided to each inflatable cell 11C. In other words, each inflatable cell 11C can be inflated independently. An dividing seam 103C is formed between two adjacent inflatable cells 11C, wherein the dividing seam 103C can be implemented as a heat sealing line between each two adjacent inflatable cells 11C, so that the inflatable cavity 12C is divided into a plurality of individual inflatable cavity 12C via the dividing seam 103C. Thus, when one of the inflatable cells 11C is damaged to leak, other inflatable cells 11C will not be affected. Of course, it is worth mentioning that the inflatable cells 11C can also communicate with each other. Thus only one inflating valve 20C is needed to inflate to all of the inflatable cells 11C. In other words, the staggered laminated air packaging device according to the present invention can form a plurality of inflatable cells 11C via the heat sealing of the first chamber layer 101C and the second chamber layer 102C. It is worth mentioning that the inflating valve 20C being provided in the inner-layer inflatable packaging body 1C or the outer-layer inflatable packaging body 2C is exemplary only and the present invention is not intended to be limiting in this aspect.

In addition, due to the shape of each of the inflatable cells 11C can be changed after being inflated, the inflatable main body 10C can be made to form several of shapes and sizes. The inflatable cells 11C can be strip (such as horizontal strip and/or lengthways strip), lump and so on. The shape thereof is not limited. According to the preferred embodiment of the present invention, the shape of the inflatable cells 11C can be strip. According to the preferred embodiment of the present invention, the inflatable main body 10C can also form a main channel 14C. The main channel 14C communicates with the air inflating opening 13C and communicates with each of the inflatable cells 11C via one or more of the inflating valve 20C. Thus, while inflating air through the air inflating opening 13C, air will enter into the main channel 14C, then the main channel 14C guides air into each of the inflating valve 20C, and then air enters into each of the inflatable cells 11C. In other words, the main channel 14C is an air distributing channel, which distributes the air being inflated from the air inflating opening 13C to each of the inflatable cells 11C. An inflating mouth can be provided to the air inflating opening 13C, so as to connect an inflating device, such as an air pump so as to fill air into the staggered laminated air packaging device.

Each of the inflatable cells 11C of the inflatable main body 10C respectively has a plurality of bending seams 104C. Thus, each of the inflatable cells 11C further forms a plurality of corresponding sub-inflatable cells 111C. It is worth mentioning that the position of the bending seams 104C of the inflatable cells 11C are corresponding. In other words, the inflatable main body 10C has more than one line of the bending seams 104C. The bending seams 104C being provided to the inflatable cells 11C are linear arranged but not continuously. The inflatable main body 10C can be folded along the bending seams 104C, wherein a side wall is formed between two adjacent lines of the bending seams 104C, so that the staggered laminated air packaging device with air cushioning performance forms a plurality of side walls. The plurality of side walls surrounds to form a receiving cavity so as to receive the packaged items. In other words, the inflatable main body 10C has a plurality of the bending seams 104C for bending, wherein the bending seams 104C are alternately aligned with each other, so that the inflatable main body 10C forms a plurality of air chamber side walls along the bending seams 104C, thereby forming the inner-layer inflatable packaging body 1C and the outer-layer inflatable packaging body 2C.

In this preferred embodiment of the present invention, the inflatable main body 10C forms a transition portion 30C integrally connected with the inner-layer inflatable packaging body 1C and the outer-layer inflatable packaging body 2C. The transition portion 30C comprises a plurality of transition seams 31C and a plurality of transition inflatable unit 32C extended between each two adjacent transition seams 31C respectively. The transition seams 31C are inclinedly extended between the inner-layer inflatable packaging body 1C and the inflatable cells 11C of the outer-layer inflatable packaging body 2C and are integrally connected to the dividing seam 103C or the transition seams 31C is one part of the dividing seam 103C. It is worth mentioning that some transition seams 31C between the transition inflatable unit 32C can also be connected together to form such as V-shape; other transition seams 31C are inclinedly extended and each two transition seams 31C are arranged parallel to each other.

In addition, the number of the bending seams 104C of each of the inflatable cells 11C can be provided as requirement. In other words, the number of the line of the bending seams 104C of the inflatable main body 10C can change, so that the corresponding inflatable main body 10C can have a plurality of side walls. So that the staggered laminated air packaging device forms different shapes of receiving spaces so as to form the staggered laminated air packaging device with different shapes and configurations.

In addition, these bending seams 104C have not completely separated adjacent sub-inflatable cells 111C. In other words, at least one communicating channel 112C is formed between each two adjacent sub-inflatable cells 111C, so that while inflating, air enters into each of the sub-inflatable cells 111C through these communicating channels 112C. According to the embodiment shown in the drawing, the bending seams 104C is formed to the center position between each two adjacent sub-inflatable cells 111C by heat sealing. The communicating channel 112C is formed on the two sides of the bending seams 104C. According to other embodiment, two end portions of each sub-inflatable cell 111C form the bending seams 104C and the middle portion of each sub-inflatable cells 111C forms the communicating channel 112C.

As shown in the drawings, these sub-inflatable cells 111C further form an inner-layer inflatable unit 1111C of the inner-layer inflatable packaging body 1 and an outer-layer inflatable unit 1112C of the outer-layer inflatable packaging body 2C. The inner-layer inflatable units 1111C of the inner-layer inflatable packaging body 1C and the outer-layer inflatable units 1112C of the outer-layer inflatable packaging body 2C are staggered arranged. More specifically, the dividing seam 1031C between the inner-layer inflatable units 1111C of the inner-layer inflatable packaging body 1C and the dividing seam 1032C between the outer-layer inflatable units 1112C of the outer-layer inflatable packaging body 2C are staggered arranged instead of being overlapped and aligned. The inner-layer inflatable units 1111C of the inner-layer inflatable packaging body 1C and the outer-layer inflatable units 1112C of the outer-layer inflatable packaging body 2C and the outer-layer inflatable units 1112C are partially overlapped with each other instead of completely overlapped, thereby forming the staggered laminated structure of the present invention.

For example, in this preferred embodiment, the inner-layer inflatable packaging body 1C forms an inner front side wall 1*a*''', an inner back side wall 1*b*''', an inner left side wall 1*c*''', an inner right side wall 1*d*''' and an inner bottom side wall 1*e*''' and forms a receiving chamber 100C for receiving the packaged items. The outer-layer inflatable packaging body 2C forms an outer front side wall 2*a*''', an outer back side wall 2*b*''', an outer left side wall 2*c*''', an outer right side wall 2*d*''' and an outer bottom side wall 2*e*'''. Thus, the bottom side wall and the periphery walls of the inner-layer inflatable packaging body 1C and the corresponding bottom side wall and the periphery walls of the outer-layer inflatable packaging body 2C are respectively overlapped with each other so as to form the staggered laminated structure. Furthermore, take the left side of the staggered laminated air packaging device as an example, the inner left side wall 1*c*''' of the inner-layer inflatable packaging body 1C is staggered arranged with the outer left side wall 2*c*''' of the outer-layer inflatable packaging body 2C so an to form the staggered laminated structure on the left side of the staggered laminated air packaging device.

It is worth mentioning that the construction of the plurality of side walls formed by the inner-layer inflatable packaging body 1C and the outer-layer inflatable packaging body 2C is exemplary only. In practice, the size of the side walls of the inner-layer inflatable packaging body 1C and the outer-layer inflatable packaging body 2C can also be increased or decreased. For example, the top side wall is increased or one of the peripheral walls or the bottom side wall is decreased. More specifically, for example, the inner-layer inflatable packaging body 1C comprises an inner-layer inflatable bottom wall and two inner-layer inflatable side walls extended form the inner-layer inflatable bottom wall. The outer-layer inflatable packaging body 2C correspondingly comprises an outer-layer inflatable bottom wall and two outer-layer inflatable side walls extended form the outer-layer inflatable bottom wall. In other example, the inner-layer inflatable packaging body 1C and the outer-layer inflatable packaging body 2C respectively have two inflatable side walls which are connected and staggered arranged with each other instead of forming a significant bottom wall. In other words, the two inflatable side walls which are connected and staggered arranged with each other are integrally connected in the bottom portion. It is worth mentioning that the inner-layer inflatable packaging body 1C forms an inner bag having the receiving chamber 100C and the outer-layer inflatable packaging body 2C also forms an outer bag having a receiving space according to the preferred embodiment of the present invention. The inner-layer inflatable packaging body 1C is extended to the receiving space of the outer bag formed by the outer-layer inflatable packaging body 2C, thereby forming a bag-in-bag structure. Of course, the present invention is not limited in this aspect, and in practical applications, other structures can be used instead of forming a fully regular bag structure.

Thus, in this preferred embodiment of the present invention, the inner-layer inflatable units 1111C of the inner-layer inflatable packaging body 1C is arranged in a staggered arrangement with the outer-layer inflatable packaging body 2C and the outer-layer inflatable units 1112C, thereby enhancing air cushioning performance of the staggered laminated air packaging device. The inner-layer inflatable units 1111C of the inner-layer inflatable packaging body 1C and the outer-layer inflatable units 1112C of the outer-layer inflatable packaging body 2C are staggered arranged with each other so as to form a cushioning space between the inner-layer inflatable units 1111C and the outer-layer inflatable units 1112C. Therefore, the impact stress applied to the outer-layer inflatable units 1112C via the cushioning space is not directly transmitted to the packaged items, instead, a predetermined cushioning effect is provided to the outer-layer inflatable units 1112C through the cushioning space. Then the inner-layer inflatable units 1111C further provides a cushioning effect and effectively disperse the impact stress.

When the outer-layer inflatable units 1112C are applied with the impact stress, air within the outer-layer inflatable units 1112C is temporarily distributed to the inner-layer inflatable units 1111C, while the cushioning recovery force of the inner-layer inflatable units 1111C causes the air back to the outer-layer inflatable units 1112C so as to return the outer-layer inflatable units 1112C to the initial state, thereby ensuring the air not being concentrated in a particular area. The outer-layer inflatable units 1112C and the inner-layer inflatable units 1111C are overlapped with each other so as to enhance a recovery performance, thereby efficiently providing the cushioning performance.

In addition, the position of the dividing seam 1031C of the inner-layer inflatable packaging body 1C is uninflated and has a weak air cushioning performance, while the outer-layer inflatable packaging body 2C corresponding to the position of the dividing seam 1031C of the inner-layer inflatable packaging body 1C is the inflatable structure formed by the outer-layer inflatable units 1112C and the inflatable structure formed by the outer-layer inflatable units 1112C has a stronger inflatable structure. Similarly, the dividing seam 1032C of the outer-layer inflatable packaging body 2C is uninflated and has a weak air cushioning performance, while the inner-layer inflatable packaging body 1C corresponding to the position of the dividing seam 1032C of the outer-layer inflatable packaging body 2C is the inflatable structure formed by the inner-layer inflatable units 1111C and the inflatable structure formed by the inner-layer inflatable units 1111C has a stronger inflatable structure. The staggered and laminated inner-layer inflatable packaging body 1C and outer-layer inflatable packaging body 2C ensure that the air cushioning performance of each of the sides of the entire staggered laminated air packaging device is enhanced and each of the sides have substantially uniform cushioning performance.

It is worth mentioning that, in this preferred embodiment of the present invention, the dividing seam 103C is formed by three parts which are the dividing seam 1031C between two adjacent inner-layer inflatable units 1111C, the dividing seam 1032C between two adjacent outer-layer inflatable units 1112C and the transition seams 31C. In this preferred embodiment, the transition seams 31C are integrally and inclinedly extended to the dividing seam 1031C between the inner-layer inflatable units 1111C and the dividing seam 1032C between the outer-layer inflatable units 1112C.

In the present invention, the vertex positions of the inner-layer inflatable units 1111C and the outer-layer inflatable units 1112C thereof are respectively staggered, so that the thickness of the laminated inner-layer inflatable units 1111C and the outer-layer inflatable units 1112C is decreased. Moreover, the dividing seam 1031C between the inner-layer inflatable units 1111C corresponds to the main body of the outer-layer inflatable units 1112C, thus, when heat conduction and heat radiation are transmitted to the dividing seam 1031C, the heat conduction and heat radiation are prevented by the air within the inner-layer inflatable units 1111C and the heat transfer is further prevented, so that the staggered laminated air packaging device of the present invention is also suitable for packaging the packaged items which need to be insulated.

In this preferred embodiment of the present invention, take the inner-layer inflatable packaging body 1D and the outer-layer inflatable packaging body 2D respectively forming three side walls as an example. The inner-layer inflatable units 1111C further comprises an inner-layer bottom wall inflatable unit 1111*a*''' and two inner-layer side wall inflatable units 1111*b*''' and 1111*c*'''. The outer-layer inflatable units 1112C further comprises an outer-layer bottom wall inflatable unit 1112*a*''' and two outer-layer side wall inflatable units 1112*b*''' and 1112*c*'''. Wherein the inner-layer bottom wall inflatable unit 1111*a*''' and the outer-layer bottom wall inflatable unit 1112*a*''' are staggered and laminated arranged; the inner-layer side wall inflatable unit 1111*b*''' and the outer-layer side wall inflatable unit 1112*b*''' are staggered and laminated arranged; inner-layer side wall inflatable unit 1111*c*''' and the outer-layer side wall inflatable unit 1112*c*''' are staggered and laminated arranged; so that the inner-layer inflatable packaging body 1C and the outer-layer inflatable packaging body 2C are staggered and laminated arranged so as to enhance the staggered and laminated arranged.

The inner-layer inflatable packaging body 1C is internally connected to the outer-layer inflatable packaging body 2C by one or more transition portions 30C, so that when the packaged items are packaged, the packaged items are positioned so as to enhance the air cushioning performance of the staggered laminated air packaging device. More specifically, when the packaged items are stored in the staggered laminated air packaging device of the present invention and the device is waggled by being applied with the impact force, because of the pulling effect of the outer-layer inflatable packaging body 2C, the packaged items are not concentrated at a certain local position. Specifically, when the packaged items are about to be waggled to a right side corner, a left side of the inner-layer inflatable packaging body 1C of the staggered laminated air packaging device has an pulling force effect on the packaged items to return the packaged items to the initial position as the inner-layer inflatable packaging body 1C is connected to the outer-layer inflatable packaging body 2C located on the outer side. In other words, when the packaged items are stored in the inner-layer inflatable packaging body 1C of the staggered laminated air packaging device, the packaged items are tend to be remained on the fixed position and remain a predetermined distance with the outer-layer inflatable packaging body 2C located on the outer side instead of directly contacting, so that the impact stress applied on the outer-layer inflatable packaging body 2C located on outer side is uniformly dispersed by the sealing chamber instead of directly being transferred to the packaged items by the sealing chamber of the outer-layer inflatable packaging body 2C.

On the other hand, since the inner-layer inflatable packaging body 1C of the present invention is fixedly connected to the outer-layer inflatable packaging body 2C on the outer side, the cushioning space between the inner-layer inflatable packaging body 1C and the outer-layer inflatable packaging body 2C has a predetermined amount of air. When the outer-layer inflatable packaging body 2C formed by the inflatable three-dimensional package body is shook and impacted, the cushioning space between the inner-layer inflatable packaging body 1C and the outer-layer inflatable packaging body 2C and the predetermined amount of air also form one-layer of air chamber structure 3C, thereby facilitating the cushioning effect. The cushioning space between the inner-layer inflatable packaging body 1C and the outer-layer inflatable packaging body 2C and the predetermined amount of air separates the packaged items forms the sealing chamber of the outer-layer inflatable packaging body 2C, so that the impact force applied on the sealing chamber of the outer-layer inflatable packaging body 2C is prevented from directly being transmitted to the packaged items. Therefore, because of the air cushioning effect between the inner-layer inflatable packaging body 1C and the outer-layer inflatable packaging body 2C, the two-layer inflatable packaging body enhances the air cushioning performance of the staggered laminated air packaging device.

It is worth mentioning that as one staggered layer of the inner-layer inflatable packaging body 1C is added inside of the outer-layer inflatable packaging body 2C, the reliability of the staggered laminated air packaging device is also enhanced. For example, when one of the inflatable cells 11C is damaged, the adjacent outer-layer inflatable packaging body 2C and the inner-layer inflatable packaging body 1C have a single layer in the vicinity of the position of the damaged inflatable cells 11C because of the staggered laminated structure of the present invention, thereby maintaining a cushioning effect.

In addition, the outer-layer inflatable packaging body 2C and end inflatable unit 1113C of two end portions of the inner-layer inflatable packaging body 1C are connected by an end connecting seam 114C. An inner connecting seam 115C is provided on the inner-layer inflatable packaging body 1C, wherein the inner connecting seam 115C seals and connects side cushioning units 1114C, so that the side cushioning unit 1114C and the end inflatable unit 1113C provide the cushioning space, thus the side portion of the inflatable units also form laminated structure so as to have a strong elastic restoring force, thereby enhancing the cushioning performance of the side portion of the staggered laminated air packaging device.

More specifically, for example, the end connecting seam 114C comprises an inner-layer front end connecting seam 1141C, an inner-layer back end connecting seam 1142C, an outer-layer front end connecting seam 1143C and an outer-layer back end connecting seam 1144C. The inner-layer front end connecting seam 1141C and the inner-layer back end connecting seam 1142C are heat sealed once so as to form the two-layer structure, so that the inner-layer inflatable packaging body 1C forms the two side walls 1*c*''' and 1*d*'''. The outer-layer front end connecting seam 1143C and the outer-layer back end connecting seam 1144C also are heat sealed once so as to form the two-layer structure, so that the outer-layer inflatable packaging body 2C forms the two side walls 2*c*''' and outer right side wall 2*d*'''. It is worth mentioning that the inner-layer front end connecting seam 1141C and the inner-layer back end connecting seam 1142C also can integrally extended to the inner-layer bottom wall 1*e*''' and the outer-layer front end connecting seam 1143C and the outer-layer back end connecting seam 1144C also can integrally extended to the outer-layer bottom wall 2*e*'''.

The inner connecting seam 115C is provided between two inner-layer inflatable units 1111C which are disposed on the left and right side of the inner-layer inflatable packaging body 1C, so that the left and right side of the inner-layer inflatable packaging body 1C respectively form laminated structure of the inflatable units, thereby enhancing the air cushioning performance of the two sides. In some embodiments, the end inflatable unit 1113C of the inner-layer inflatable packaging body 1C which is adjacent to the inner connecting seam 115C also can form inflatable structure so as to provide cushioning spaces and to enhance the contraction effect of the side portion chambers.

In addition, the inflatable main body 10C further comprises a main channel sealing line 116C and an end portion sealing line 117C. The main channel sealing line 116C and the end portion sealing line 117C are provided on two end chambers of the inflatable main body 10C and formed by being heat sealed. In practical, the main channel sealing line 116C and the end portion sealing line 117C can be heat sealed once to be formed. Moreover, in this preferred embodiment, the inner-layer inflatable packaging body 1C and the outer-layer inflatable packaging body 2C are heat sealed by the main channel sealing line 116C and the end portion sealing line 117C. The heat sealing position is disposed on the front side wall or the back side wall of the inner-layer inflatable packaging body 1C and the outer-layer inflatable packaging body 2C. For example, the heat sealing of the main channel sealing line 116C and the end portion sealing line 117C is used to connect the front side wall 1*a*''' of the inner-layer inflatable packaging body 1C and the front side wall 2*a*''' of the outer-layer inflatable packaging body 2C.

It is worth mentioning that each of the inner-layer inflatable packaging body 1C and the outer-layer inflatable packaging body 2C further comprises two folding units 40C respectively corresponding to two corners of the inflated staggered laminated air packaging device, so that the corner position of the staggered laminated air packaging device is easy to be folded and facilitates the formation of the three-dimensional configuration. Moreover, the bottom wall and the four peripheral walls are respectively arranged with right angles therebetween, so that a regular rectangular or square shaped receiving space is formed among the bottom wall and the four peripheral walls. The arrangement of the folding units 40C ensures that the inner-layer inflatable packaging body 1C forms the two side walls 1*c*''' and the 1*d*''' and the outer-layer inflatable packaging body 2C forms the two side walls 2*c*''' and outer right side wall 2*d*'''; and these side walls respectively form a substantially right angle with the adjacent bottom wall, the front side wall and the back side wall; so that the entire staggered laminated air packaging device is suitable to receive substantially square shaped packaged items.

Figure 30:
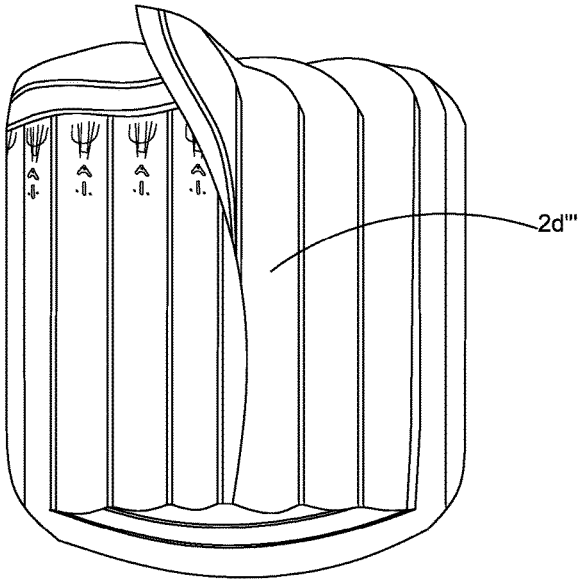
FIG. 30 is a schematic view of the staggered laminated air packaging device according to the fourth preferred embodiment of the present invention, illustrating the lateral structure of the staggered laminated air packaging device.
Figure 31:
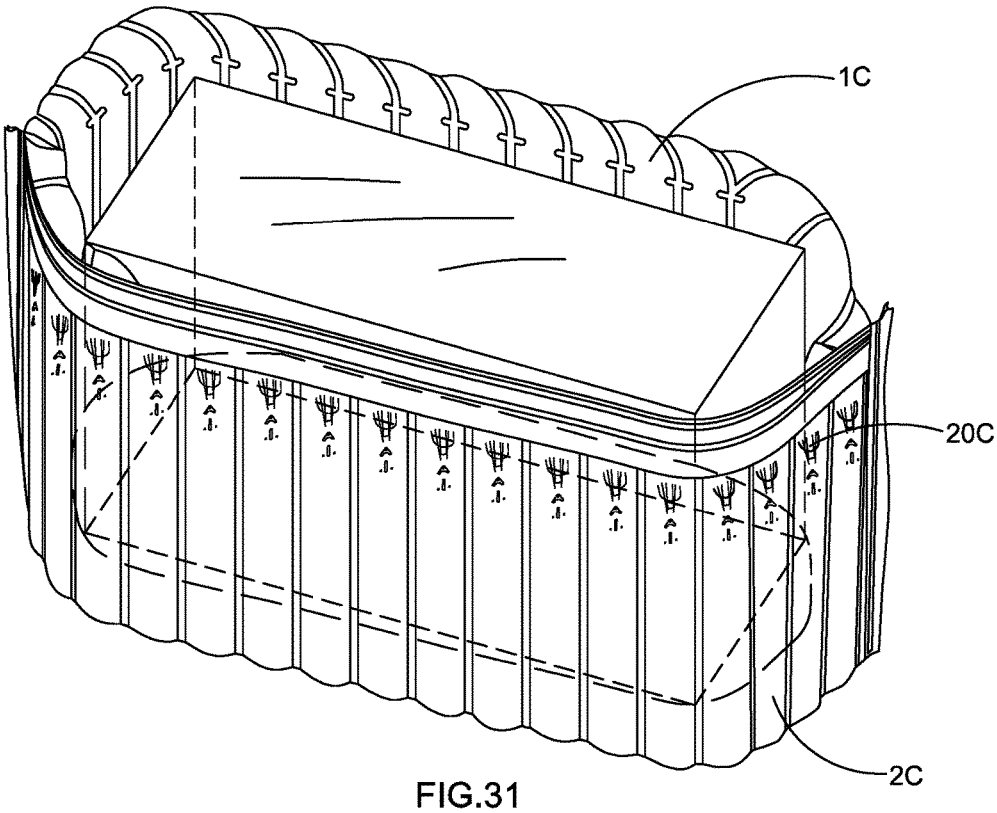
FIG. 31 is a perspective view of the staggered laminated air packaging device according to the above fourth preferred embodiment of the present invention, wherein the staggered laminated air packaging device is applied to a packaged item.

Each of the folding units 40C is provided with a plurality of air blocking seams 401C corresponding to the sub-inflatable cells 111C, wherein the air blocking seams 401C reduce the amount of the inflated air of corresponding sub air chamber units 411C, thereby facilitating the folding of the entire folding units 40C. While the air blocking seams 401C can be formed by heat sealing and the shape, the size and the location thereof are not limited. For example, the air blocking seams 401C can be a plurality of transversely or longitudinally arranged heat sealing lines or heat sealing blocks. It is worth mentioning that the folding units 40C can be protruded outwardly at the outer side of the staggered laminated air packaging device. Alternatively, the folding units 40C are disposed inside of the staggered laminated air packaging device as shown in FIG. 30 of the drawings.

Figure 32:
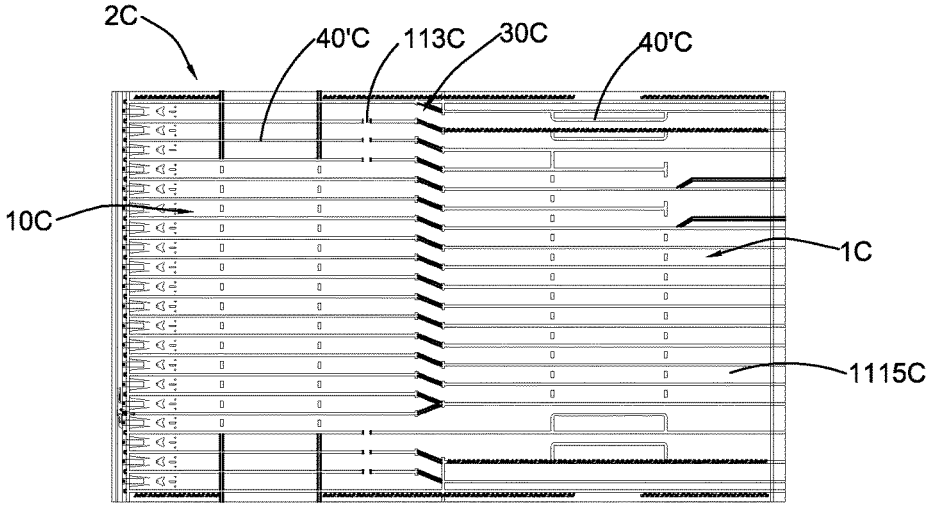
FIG. 32 is a schematic view of the staggered laminated air packaging device according to the fourth preferred embodiment of the present invention, wherein the staggered laminated air packaging device is not inflated and is unfolded.
Figure 33:
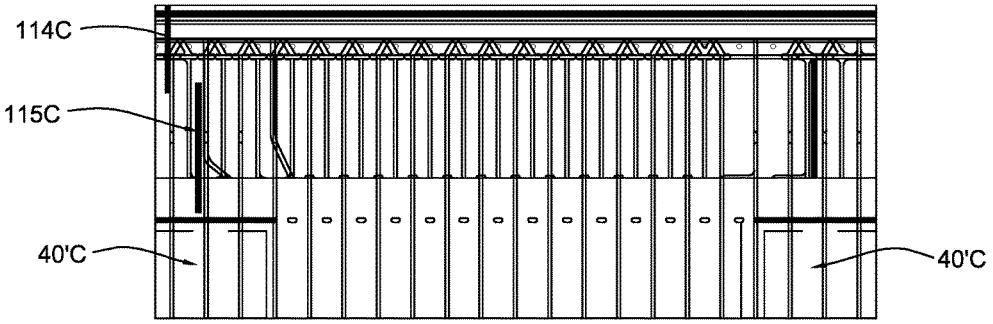
FIG. 33 is a schematic view of an alternative mode of the staggered laminated air packaging device according to the fourth preferred embodiment of the present invention of FIG. 32, illustrating the lateral structure of the staggered laminated air packaging device, wherein the staggered laminated air packaging device is folded and is heat sealed.
Figure 34:
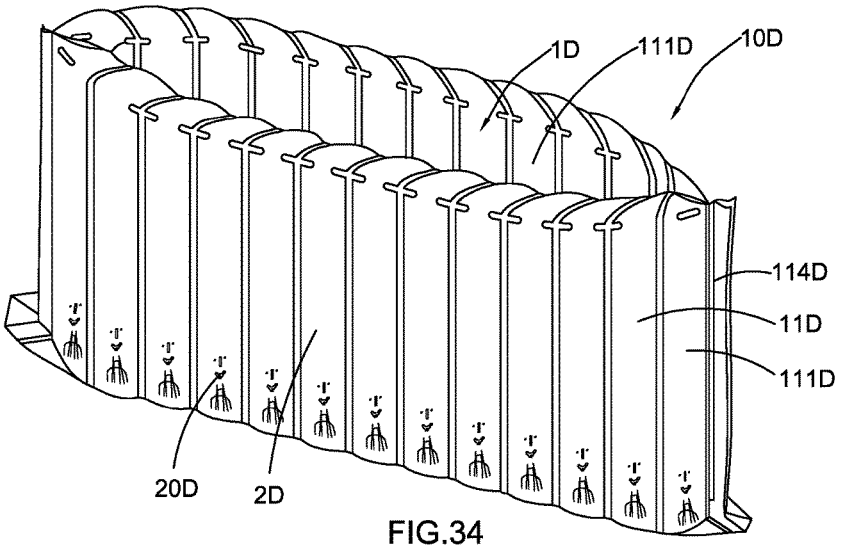
FIG. 34 is a perspective view of a multilayer air Packaging device according to a fifth preferred embodiment of the present invention.
Figure 35:
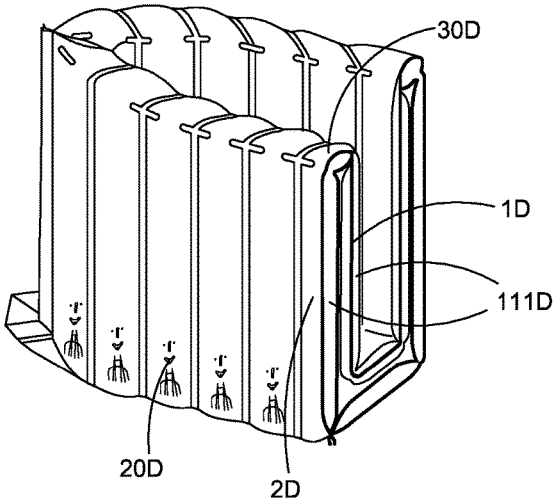
FIG. 35 is a sectional view of the staggered laminated air packaging device according to the above fifth preferred embodiment of the present invention.
Figure 36:
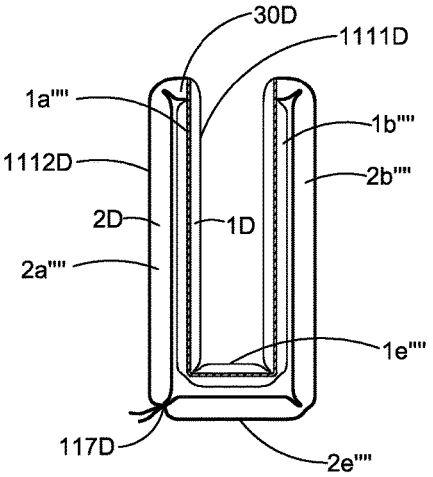
FIG. 36 is a sectional view of FIG. 35.
Figure 37:
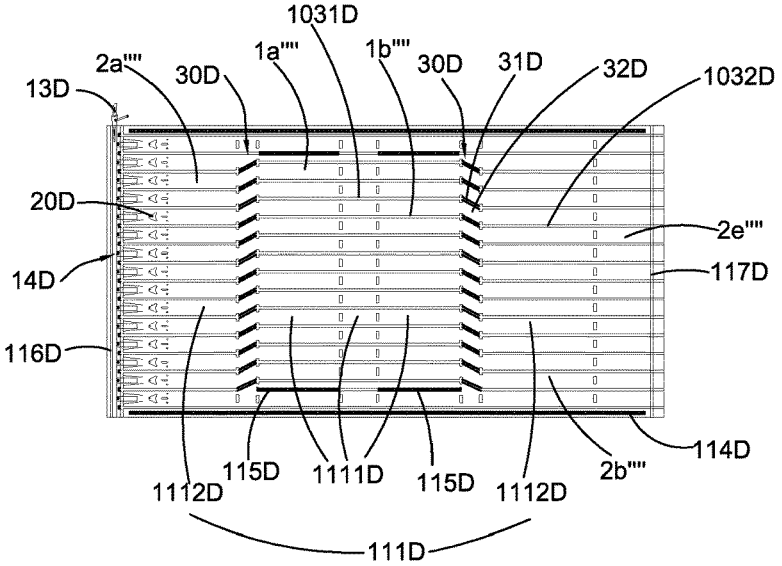
FIG. 37 is a schematic view of the staggered laminated air packaging device according to the fifth preferred embodiment of the present invention, wherein the staggered laminated air packaging device is not inflated and is unfolded.
Figure 38:
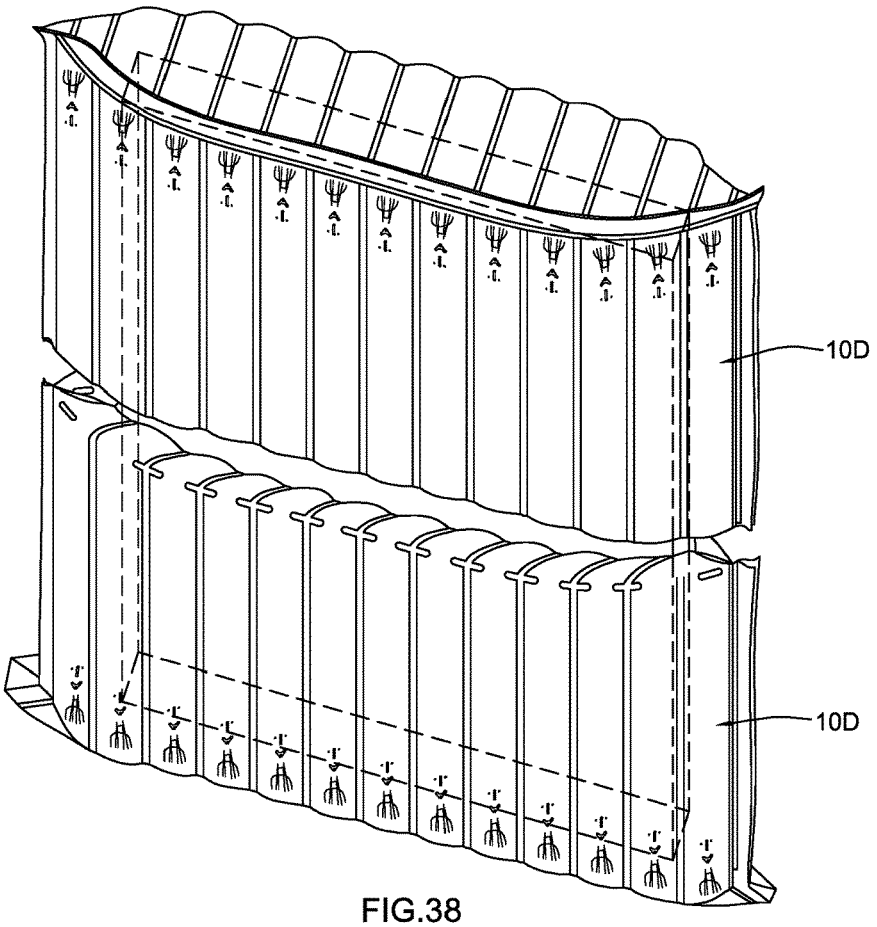
FIG. 38 is a perspective view of the multilayer air Packaging device according to the above fifth preferred embodiment of the present invention, wherein the multilayer air Packaging device is applied to a packaged item.

According to other embodiment as shown in FIG. 32 and FIG. 33 of the drawings, the folding units 40C can be uninflation units which cannot be inflated while the air distribution is achieved by transversely communicating channel between the sub-inflatable cells. In addition, the sub-inflatable cells of the inner-layer inflatable packaging body 1C and the outer-layer inflatable packaging body 2C can have different diameters to fit the shape and size of the items to be packaged. Furthermore, the sub-inflatable cells with different diameters can achieve a multi-level cushion, thereby enhancing the air cushioning performance of the entire staggered laminated air packaging device. In this preferred embodiment, the side portion of the inner-layer inflatable packaging body 1C has large-diameter air chambers, so that the inner wall of the side portion of the inner-layer inflatable packaging body 1C is substantially arc-shaped, thereby fitting to the packaged items and also has an effect on tightening the opening.

Referring to FIG. 34 to FIG. 38 of the drawings, a staggered laminated air packaging device according to a fifth preferred embodiment of the present invention is illustrated, wherein the staggered laminated air packaging device in the fifth preferred embodiment has a similar structure with the staggered laminated air packaging device in the fourth preferred embodiment and the staggered laminated air packaging device in the fifth preferred embodiment is more suitable to package flat or thin items.

Similarly, the staggered laminated air packaging device comprises an inner-layer inflatable packaging body 1D and an outer-layer inflatable packaging body 2D which are overlapped and staggered with each other so as to enhance the cushioning performance of the peripheral wall of the staggered laminated air packaging device. The inner-layer inflatable packaging body 1D and the outer-layer inflatable packaging body 2D can be implemented as a separate inflatable structure respectively and are connected to each other by a connection manner such as heat-seal connection so as to be a whole structure. Also the inner-layer inflatable packaging body 1D and the outer-layer inflatable packaging body 2D can be implemented as an integrated structure. In the preferred embodiment of the present invention, take the integrated structure as an example, the inner-layer inflatable packaging body 1D and the outer-layer inflatable packaging body 2D are integrally formed by a inflatable main body 10D. Of course, the whole structure which is formed by the separate inner-layer inflatable packaging body 1D and the separate outer-layer inflatable packaging body 2D also has a multi-layer structure, thereby enhancing the cushioning performance of the staggered laminated air packaging device.

The inflatable main body 10D further comprises two transition portions 30D, wherein the inner-layer inflatable packaging body 1D or the outer-layer inflatable packaging body 2D is formed between the two transition portions 30D. The inner-layer inflatable packaging body 1D and the outer-layer inflatable packaging body 2D are laminated and staggered with each other so as to enhance the cushioning performance of the peripheral wall of the staggered laminated air packaging device.

As shown in the drawings, the inner-layer inflatable units 1111D of the inner-layer inflatable packaging body 1D and the outer-layer inflatable units 1112C of the outer-layer inflatable packaging body 2D are staggered arranged. More specifically, the dividing seam 1031D between the inner-layer inflatable units 1111D of the inner-layer inflatable packaging body 1D and the dividing seam 1032D between the outer-layer inflatable units 1112C of the outer-layer inflatable packaging body 2D are staggered arranged instead of being overlapped. The inner-layer inflatable units 1111D of the inner-layer inflatable packaging body 1D and the outer-layer inflatable units 1112C of the outer-layer inflatable packaging body 2D and the outer-layer inflatable units 1112C are partially overlapped with each other instead of completely overlapped, thereby forming the staggered laminated structure of the present invention.

For example, in this preferred embodiment, the inner-layer inflatable packaging body 1D forms an inner front side wall 1*a*"", an inner back side wall 1*b*"" and an inner bottom side wall 1*e*"" and forms a receiving chamber for receiving the packaged items. The outer-layer inflatable packaging body 2D forms an outer front side wall 2*a*"", an outer back side wall 2*b*"" and an outer bottom side wall 2*e*"". Take the front side of the staggered laminated air packaging device as an example, the inner front side wall 1*a*"" of the inner-layer inflatable packaging body 1D is staggered arranged with the outer front side wall 2*a*"" of the outer-layer inflatable packaging body 2D so as to form the staggered laminated structure on the left side of the staggered laminated air packaging device. It is worth mentioning that in this preferred embodiment, when the inner-layer inflatable packaging body 1D is heat sealed with the outer-layer inflatable packaging body 2D, the outer front side wall 2*a*"" and the outer bottom side wall 2*e*"" of the outer-layer inflatable packaging body 2D is heat sealed by the main channel sealing line 116D and the end portion sealing line 117D.

Thus, in this preferred embodiment of the present invention, the inner-layer inflatable units 1111D of the inner-layer inflatable packaging body 1D is arranged in a staggered arrangement with the outer-layer inflatable packaging body 2D and the outer-layer inflatable units 1112C, thereby enhancing air cushioning performance of the staggered laminated air packaging device. The inner-layer inflatable units 1111D of the inner-layer inflatable packaging body 1D and the outer-layer inflatable units 1112C of the outer-layer inflatable packaging body 2D are staggered arranged with each other so as to form a cushioning space between the inner-layer inflatable units 1111D and the outer-layer inflatable units 1112C. Therefore, the impact stress applied to the outer-layer inflatable units 1112C via the cushioning space is not directly transmitted to the packaged items, instead, a predetermined cushioning effect is provided to the outer-layer inflatable units 1112C through the cushioning space. Then the inner-layer inflatable units 1111D further provides cushioning effects and effectively disperses the impact stress.

It is worth mentioning that in these two embodiments, the length of the sub-inflatable cells of the inner-layer inflatable packaging body 1D can be smaller than or substantially the same with the length of the sub-inflatable cells of the outer-layer inflatable packaging body 2D. The bottom wall of the inner-layer inflatable packaging body 1D has a predetermined distance with the bottom wall of the outer-layer inflatable packaging body 2D when the length of the sub-inflatable cells of the inner-layer inflatable packaging body 1D is small, so that the inner-layer inflatable packaging body 1D is suspended within the outer-layer inflatable packaging body 2D to enhance the bottom cushioning effect. Of course, in other embodiments, the outer surface of the bottom wall of the inner-layer inflatable packaging body 1D can also be in contact with the inner surface of the bottom wall of the outer-layer inflatable packaging body 2D after inflation.

It is worth mentioning that the above-mentioned various seams such as dividing seams, bending seams, transition seams and inner connecting seam both can be formed by heat sealing process. Wherein two or more layers of flexible films are heat-seat together by the heat sealing process.

Figure 39:
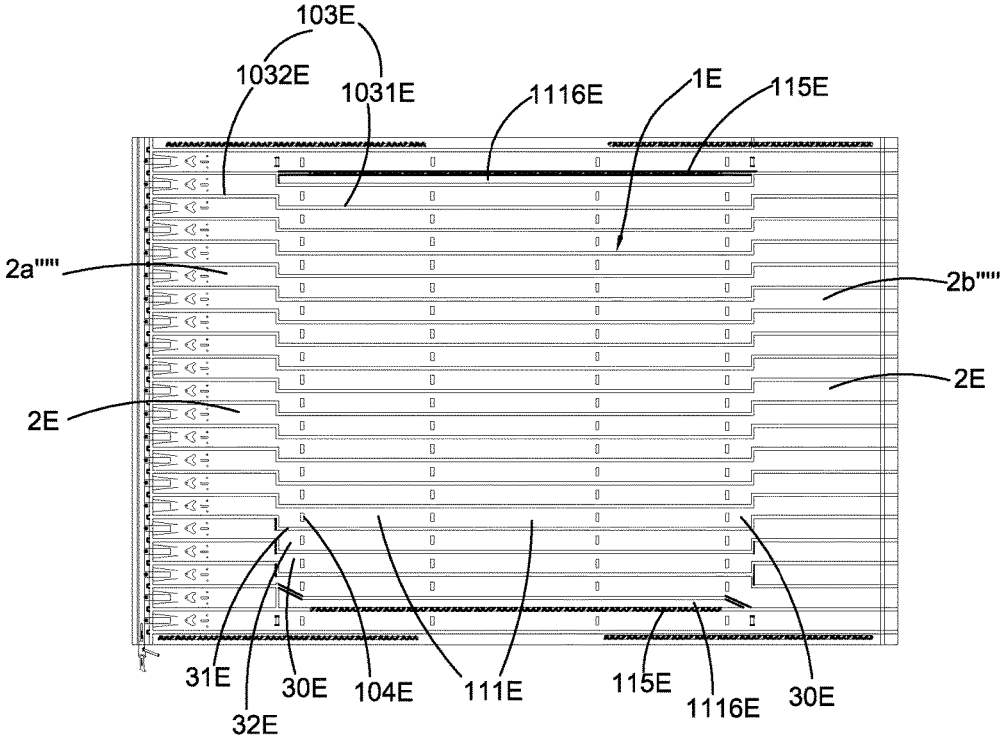
FIG. 39 is a perspective view of a staggered laminated air packaging device according to a sixth preferred embodiment of the present invention.
Figure 40:
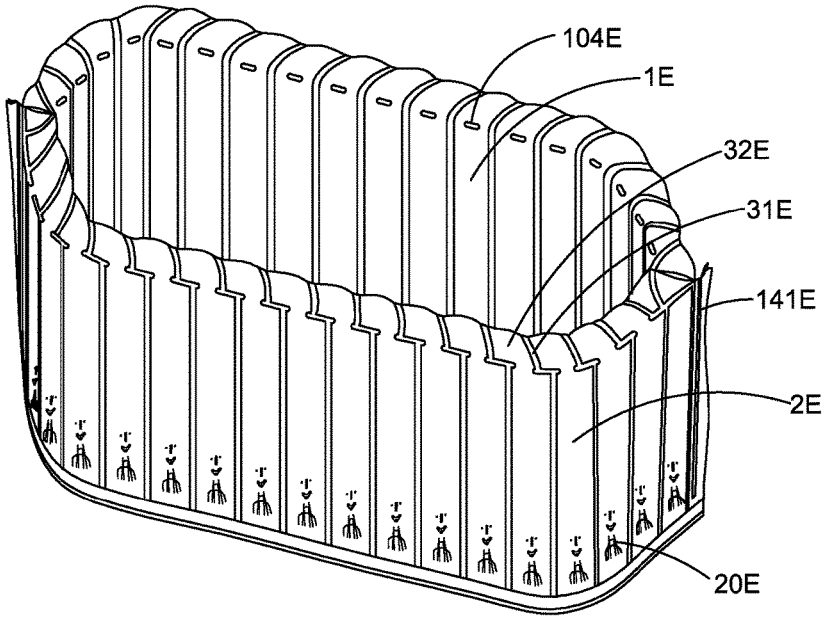
FIG. 40 is a sectional view of the staggered laminated air packaging device according to the above sixth preferred embodiment of the present invention.

Referring to FIG. 39 to FIG. 40 of the drawings, a staggered laminated air packaging device according to a sixth preferred embodiment of the present invention is illustrated. According to this preferred embodiment, similarly, the staggered laminated air packaging device comprises an inner-layer inflatable packaging body 1E and an outer-layer inflatable packaging body 2E. However, the difference is that the outer-layer inflatable packaging body 2E can has no bottom walls and only has two side walls 2*a*'''' and 2*b*'''', wherein the side walls 2*a*'''', and the 2*b*'''' are spaced apart from each other and parallel to each other.

Similarly, the inner-layer inflatable packaging body 1E is formed by an inner-layer inflatable unit 1111E between two side walls 2*a*'''' and the 2*b*'''', wherein the two transition portions 30E respectively have a line of bending seams 104E and a plurality of transition inflatable unit 32E between the transition seams 31E. The transition seams 31E are integrally extended in form of L-shaped between the dividing seam 1031E of the inner-layer inflatable packaging body 1E and the dividing seam 1032E of the outer-layer inflatable packaging body 2E.

The inner-layer inflatable packaging body 1 further forms inflatable chamber 1116E adjacent to the inner connecting seam 115E, so that more cushioning spaces are formed between the inner-layer inflatable units 1111E on two sides of the inner connecting seam 115E, thereby enhancing lateral elastic restoring force.

One skilled in the art will understand that the above-described transition seams 31E of the transition portions 30E can also be other shapes, such as arcuate, other curvilinear, as long as the inner-layer inflatable packaging body 1E and the inflatable cells of the outer-layer inflatable packaging body 2E form staggered structure after being laminated into two-layer or multi-layer structure.

Figure 41:
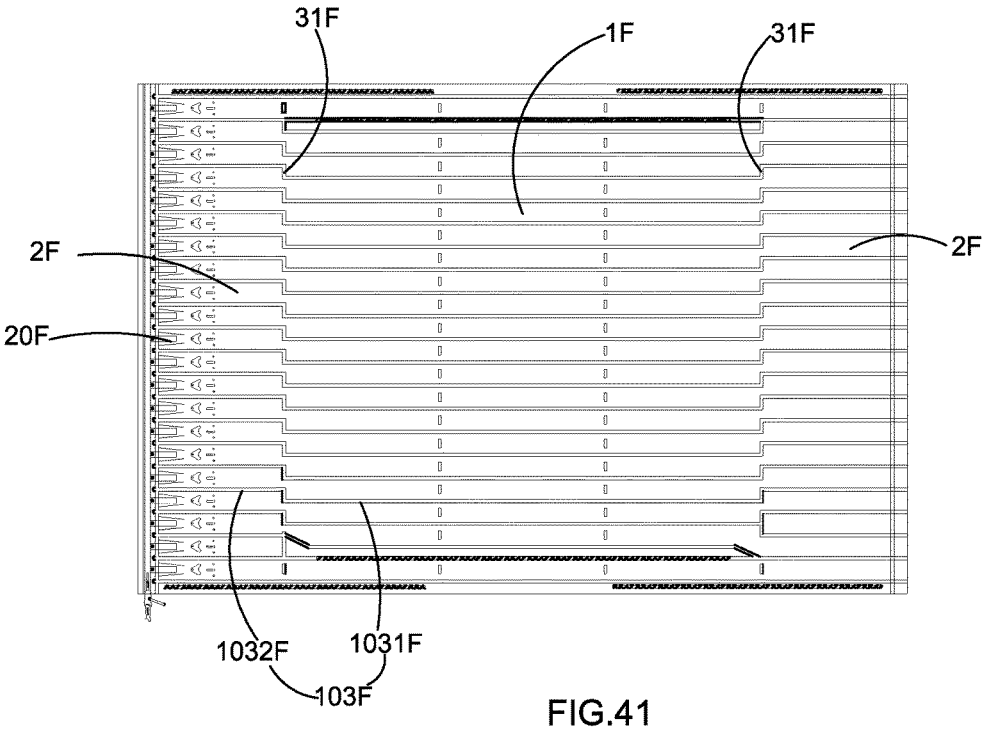
FIG. 41 is a perspective view of an alternative mode of the staggered laminated air packaging device according to the sixth preferred embodiment of the present invention.
Figure 42:
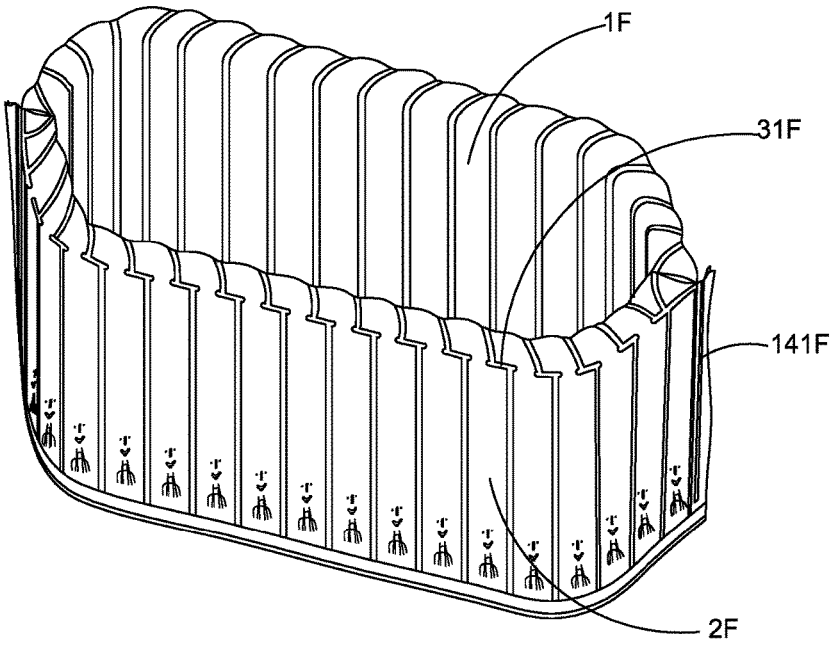
FIG. 42 is a schematic view of the staggered laminated air packaging device according to the sixth preferred embodiment of the present invention, wherein the staggered laminated air packaging device is not inflated and is unfolded.

Referring to FIG. 41 to FIG. 42 of the drawings, a staggered laminated air packaging device according to an alternative mode of the sixth preferred embodiment of the present invention is illustrated. According to this preferred embodiment, similarly, the staggered laminated air packaging device comprises an inner-layer inflatable packaging body 1F and an outer-layer inflatable packaging body 2F. However, the staggered laminated air packaging device has no apparent transition portions 30E of above embodiment. More specifically, the inner-layer inflatable packaging body 1F and the outer-layer inflatable packaging body 2F are integrally connected by the transition seams 31F. The transition seams 31F are integrally and perpendicularly extended between the dividing seam 1031F of the inner-layer inflatable packaging body 1F and the dividing seam 1032F of the outer-layer inflatable packaging body 2F; and the dividing seam 1031F and the dividing seam 1032F are longitudinally arranged along a length direction and the transition seams 31F is perpendicularly arranged; so that the transition seams 31F relatively form the bending heat-seal seam between the inner-layer inflatable packaging body 1F and the outer-layer inflatable packaging body 2F so as to facilitate the buckling between the inner-layer inflatable packaging body 1F and the outer-layer inflatable packaging body 2F; thereby forming the two-layer staggered structure.

Figure 43:
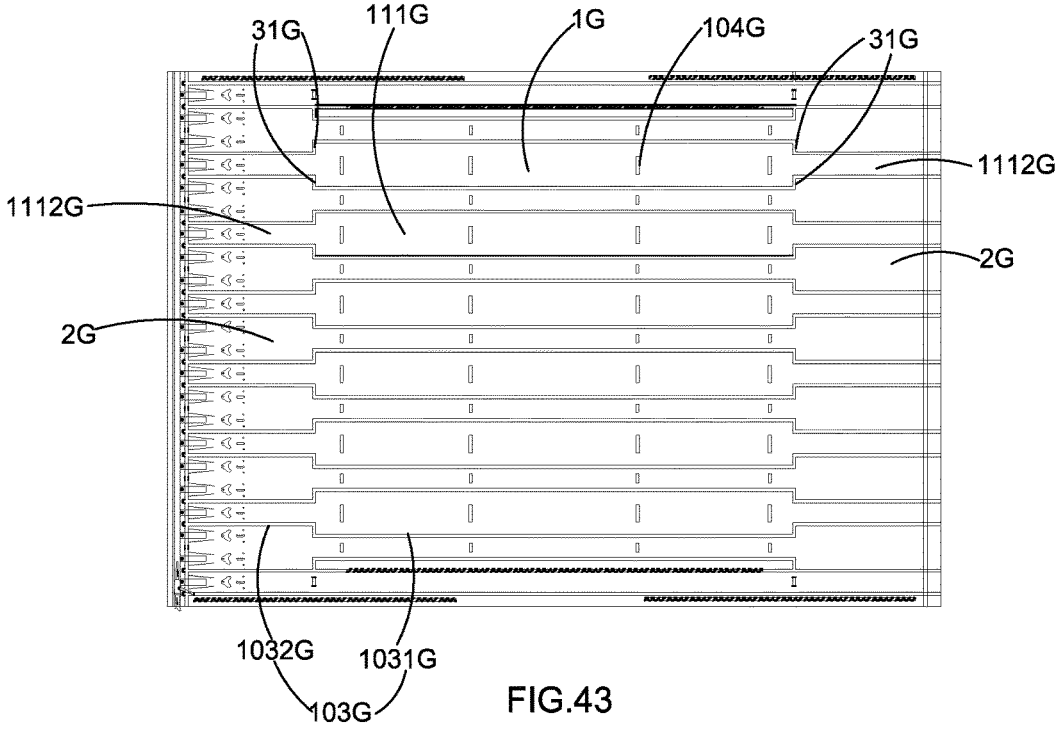
FIG. 43 is a perspective view of another alternative mode of the multilayer air Packaging device according to the sixth preferred embodiment of the present invention.
Figure 44:
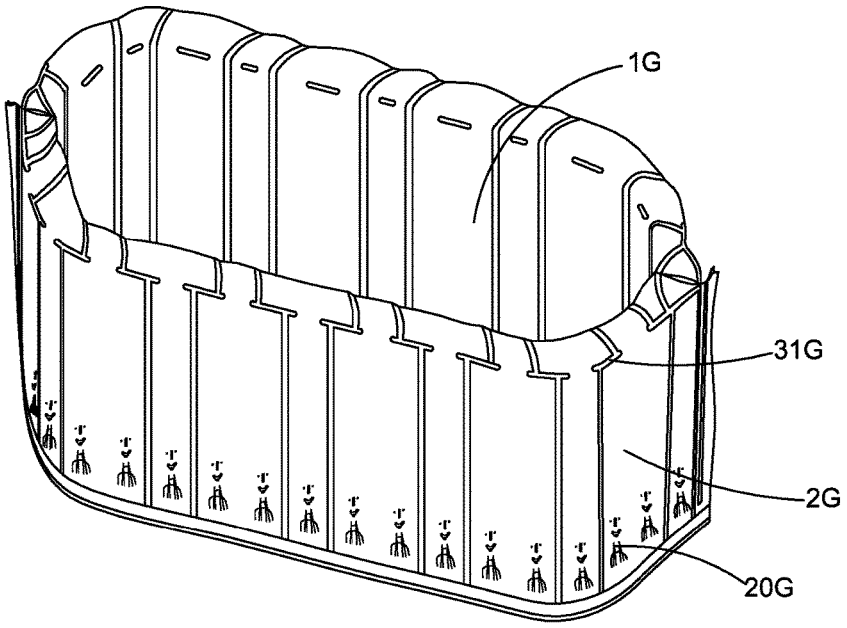
FIG. 44 is a schematic view of the staggered laminated air packaging device according to the above preferred embodiment of the present invention, wherein the staggered laminated air packaging device is not inflated and is unfolded.

Referring to FIG. 43 to FIG. 44 of the drawings, a staggered laminated air packaging device according to another alternative mode of the sixth preferred embodiment of the present invention is illustrated. According to this preferred embodiment, similarly, the staggered laminated air packaging device comprises an inner-layer inflatable packaging body 1G and an outer-layer inflatable packaging body 2G. The difference is that the inner-layer inflatable units 1111G of the inner-layer inflatable packaging body 1G are large-diameter air chambers and small-diameter air chambers which are staggered arranged, and the outer-layer inflatable units 1112G of the outer-layer inflatable packaging body 2G also are large-diameter air chambers and small-diameter air chambers which are staggered arranged, and the two adjacent transition seams 31G are extended toward opposite positions. Moreover, in the staggered structure, the small-diameter inner-layer inflatable units 1111G of the inner-layer inflatable packaging body 1G is staggered arranged with the large-diameter air outer-layer inflatable units 1112G of the outer-layer inflatable packaging body 2G, and the large-diameter inner-layer inflatable units 1111G of the inner-layer inflatable packaging body 1G is staggered arranged with the small-diameter air outer-layer inflatable units 1112G of the outer-layer inflatable packaging body 2G, thereby enhancing the air cushioning performance.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A multilayer air packaging device, comprising:

an inflatable main body which forms an inner-layer inflatable packaging body and an outer-layer inflatable packaging body which are overlapped with each other, wherein a receiving chamber for receiving a packaged item is formed by said inner-layer inflatable packaging body wherein said inner-layer inflatable packaging body is provided in said outer-layer inflatable packaging body, wherein said inflatable main body comprises a plurality of inflatable cells which are bended to form said inner-layer inflatable packaging body and said outer-layer inflatable packaging body, so as to provide a multilayer air cushioning structure.

2. The multilayer air packaging device, as recited in claim 1, wherein said inflatable main body comprises one or more dividing seams dividing each two adjacent inflatable cells, wherein each of said inflatable cells forms a plurality of communicated sub-inflatable cells by a plurality of bending seams and said plurality of communicated sub-inflatable cells respectively form said inner-layer inflatable packaging body and said outer-layer inflatable packaging body.

3. The multilayer air packaging device, as recited in claim 2, wherein said one or more dividing seams have a transition between said inner-layer inflatable packaging body and said outer-layer inflatable packaging body, wherein said transition is selected from the group consisting of vertical transition, inclined transition, and curved transition, rendering said sub-inflatable cells, which are overlapped with each other, having a staggered structure.

4. The multilayer air packaging device, as recited in claim 1, wherein said inflatable main body is formed by a first air chamber layer and a second air chamber layer after being heat sealed and being folded, wherein said inflatable main body forms an air inflating opening and a main channel, wherein said multiplayer air packaging device further comprises an inflating valve which comprises at least two valve films provided between said first chamber layer and said second chamber layer of said inflatable cells of said inflatable main body, so that air enters said main channel and enters into each of said inflatable cells from said main channel via said inflating valve.

5. The multilayer air packaging device, as recited in claim 3, wherein said inflatable main body is formed by a first air chamber layer and a second air chamber layer after being heat sealed and being folded, wherein said inflatable main body forms an air inflating opening and a main channel, wherein said multiplayer air packaging device further comprises an inflating valve which comprises at least two valve films provided between said first chamber layer and said second chamber layer of said inflatable cells of said inflatable main body, so that air enters said main channel and enters into each of said inflatable cells from said main channel via said inflating valve.

6. The multilayer air packaging device, as recited in claim 1, wherein said inner-layer inflatable packaging body comprises a plurality of inner-layer inflatable units and forms said receiving chamber for receiving the packaged item, wherein said outer-layer inflatable packaging body comprises a plurality of outer-layer inflatable units, wherein said inner-layer inflatable units of said inner-layer inflatable packaging body and said outer-layer inflatable units of said outer-layer inflatable packaging body are overlapped with each other so as to form said multilayer air cushioning structure, wherein said plurality of inflatable cells which are bended to form said plurality of inner-layer inflatable units and said plurality of outer-layer inflatable units.

7. The multilayer air packaging device, as recited in claim 6, wherein said inner-layer inflatable units of said inner-layer inflatable packaging body form an inner front side wall and an inner back side wall, wherein said outer-layer inflatable units of said outer-layer inflatable packaging body form an outer front side wall and an outer back side wall wherein the inner front side wall and said inner back side wall respectively form a multilayer structure with said outer front side wall and said outer back side wall.

8. The multilayer air packaging device, as recited in claim 7, wherein said inner-layer inflatable packaging body further comprises an inner bottom wall, wherein said outer-layer inflatable packaging body further comprises an outer bottom wall formed by said outer-layer inflatable units, wherein said outer-layer inflatable units of said outer bottom wall and said inner-layer inflatable units of said inner bottom side wall are overlapped with each other.

9. The multilayer air packaging device, as recited in claim 8, wherein said inner-layer inflatable packaging body further comprises an inner left side wall and an inner right side wall formed by said inner-layer inflatable units and said outer-layer inflatable packaging body further comprises an outer left side wall and an outer right side wall formed by said outer-layer inflatable units.

10. The multilayer air packaging device, as recited in claim 6, wherein said inner-layer inflatable packaging body and said outer-layer inflatable packaging body are integrally connected and are formed by said inflatable main body, wherein said inflatable main body comprises said plurality of inflatable cells aligned side by side and one or more dividing seams dividing each two adjacent inflatable cells, wherein each of said inflatable cells are divided into a plurality of communicated sub-inflatable cells by a plurality of bending seams and said plurality of communicated sub-inflatable cells form said inner-layer inflatable units and said outer-layer inflatable units which are arranged along a longitudinal direction.

11. The multilayer air packaging device, as recited in claim 10, wherein said one or more dividing seams have a transition between said inner-layer inflatable packaging body and said outer-layer inflatable packaging body, wherein said transition is selected from the group consisting of vertical transition, inclined transition, and curved transition, rendering said inner-layer inflatable units and said outer-layer inflatable units which are arranged along the longitudinal direction and overlapped with each other, having a staggered structure.

12. The multilayer air packaging device, as recited in claim 11, wherein said inflatable main body is formed by a first air chamber layer and a second air chamber layer after being heat sealed and being folded, wherein said inflatable main body forms an air inflating opening and a main channel, wherein said multiplayer air packaging device further comprises an inflating valve which comprises at least two valve films provided between said first chamber layer and said second chamber layer of said inflatable cells of said inflatable main body, so that air enters said main channel and enters into each of said inflatable cells from said main channel via said inflating valve.

* * * * *